United States Patent [19]

Stafford et al.

[11] Patent Number: 4,676,697

[45] Date of Patent: Jun. 30, 1987

[54] MOVABLE ROOF SUPPORT AND BOLTER SYSTEM

[76] Inventors: Frank K. Stafford, Box 1434; Robert C. Nasby, 236 Tolley Dr., both of, Beckley, W. Va. 25801

[21] Appl. No.: 723,045

[22] Filed: Apr. 15, 1985

[51] Int. Cl.[4] ..... E21D 15/44

[52] U.S. Cl. ..... 405/291; 175/219; 405/288; 405/290

[58] Field of Search ..... 405/288, 290–301, 405/150, 151, 152, 146, 141, 138; 299/11, 32, 33; 52/722, 723, 724, 725, 731; 296/31 P; 175/113, 202, 203, 211, 212, 219, 220, 230

[56] References Cited

U.S. PATENT DOCUMENTS

| | | | |
|---|---|---|---|
| 2,795,936 | 6/1957 | Blower et al. | 405/300 |
| 2,899,800 | 8/1959 | Joy | 405/298 |
| 3,115,754 | 12/1963 | Joseph | 405/297 |
| 3,357,742 | 12/1967 | Dommann et al. | 299/32 |
| 3,871,707 | 3/1975 | Jamison | 299/33 X |
| 4,143,991 | 3/1979 | Stafford | 405/291 |
| 4,274,764 | 6/1981 | Curry | 405/291 |
| 4,290,490 | 9/1981 | Barthe et al. | 175/219 X |
| 4,297,057 | 10/1981 | O'Neil | 175/219 X |
| 4,391,469 | 7/1983 | Avsuaga | 299/32 X |

*Primary Examiner*—Dennis L. Taylor
*Attorney, Agent, or Firm*—Stanley J. Price, Jr.

[57] ABSTRACT

A mine roof support system includes a plurality of truss members each having first and second ends which are positioned in spaced relationships one behind another. There are vertically extensible props under each end of the truss member which include stabilizer sleeves to stabiize the truss members thereabove. The vertically extensible props can be extended and retracted to adjust a vertical height of the props for supporting the truss member and for moving it into and out of engagement with the mine roof. Each of the props is supported by a ground engaging means in the form of a selectively operable propulsion unit capable of being operated to produce horizontal movement of the respective props and ends of the truss members. Connecting elements beneath the ends of the truss members connect the props in tandem relationship to permit the horizontal movement of truss members and associated props relative to each other by the propulsion units. Each of the truss members is horizontally expandable to facilitate transportion through a mine passageway prior to being positioned for movement into and out of engagement with the mine roof. The truss member can include a major portion which is fabricated of reinforced fiberglass to permit deflection without permanent deformation when supporting the mine roof to provide a warning prior to any failure of the truss member under the weight of the mine roof.

20 Claims, 19 Drawing Figures

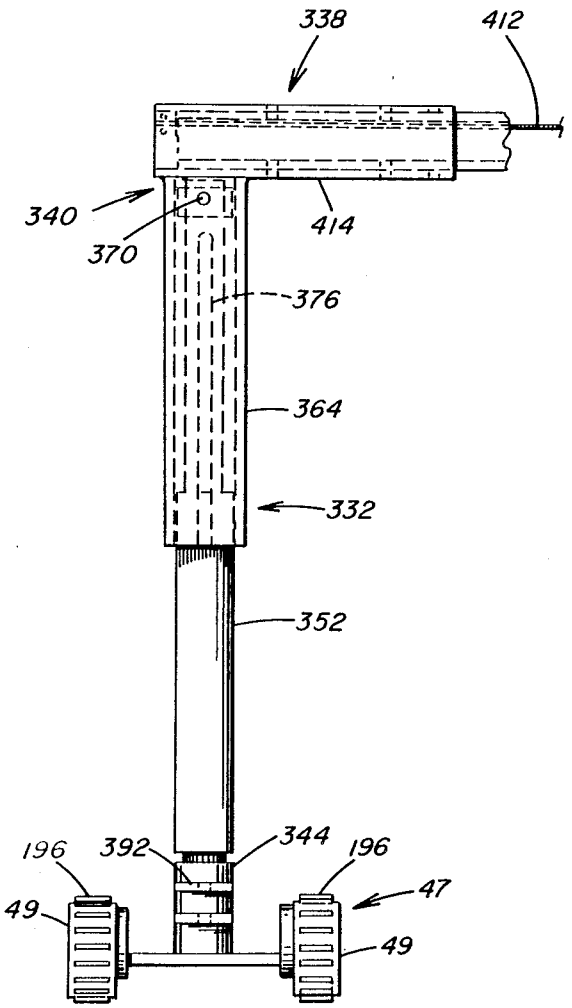
FIG. 13
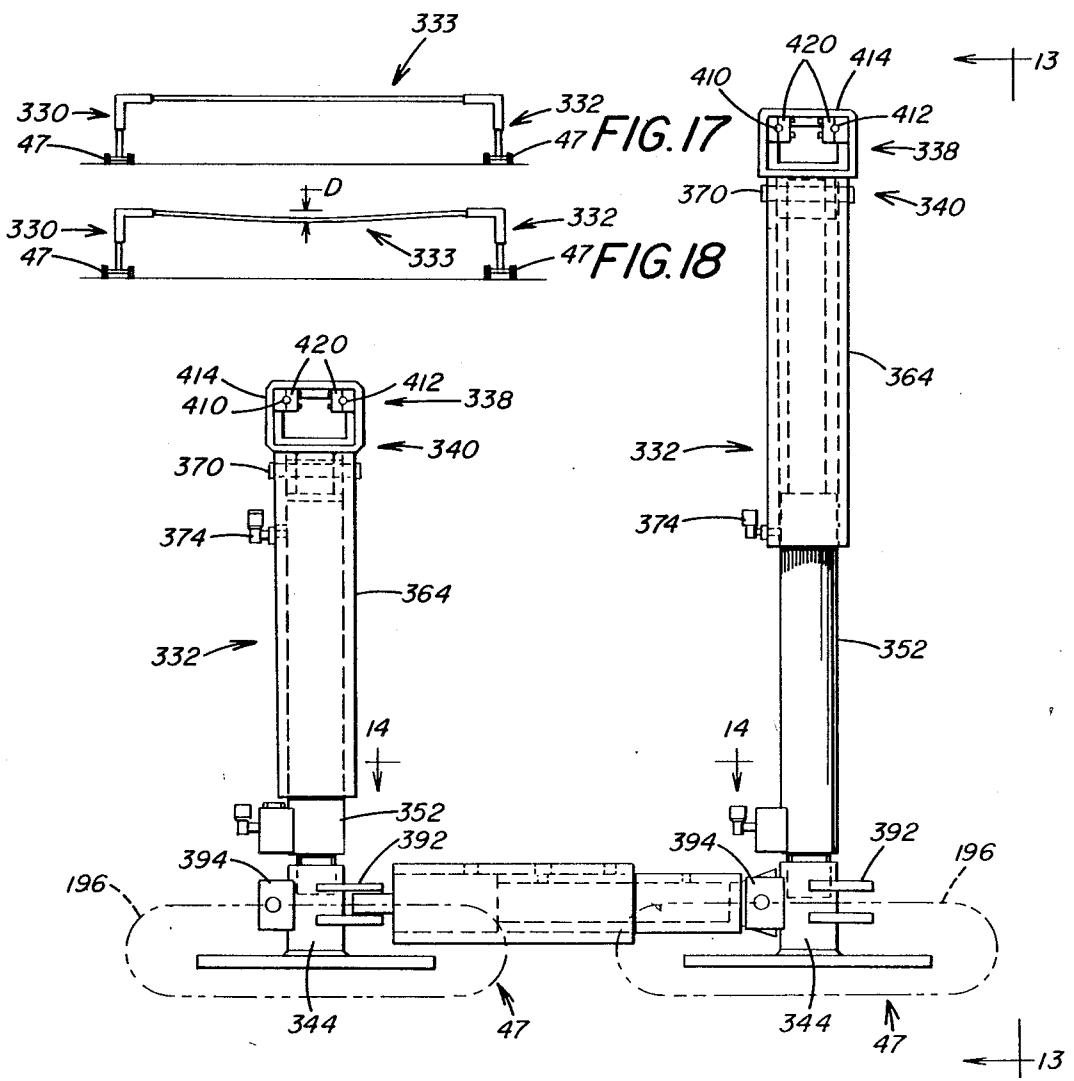
FIG. 17
FIG. 18
FIG. 12

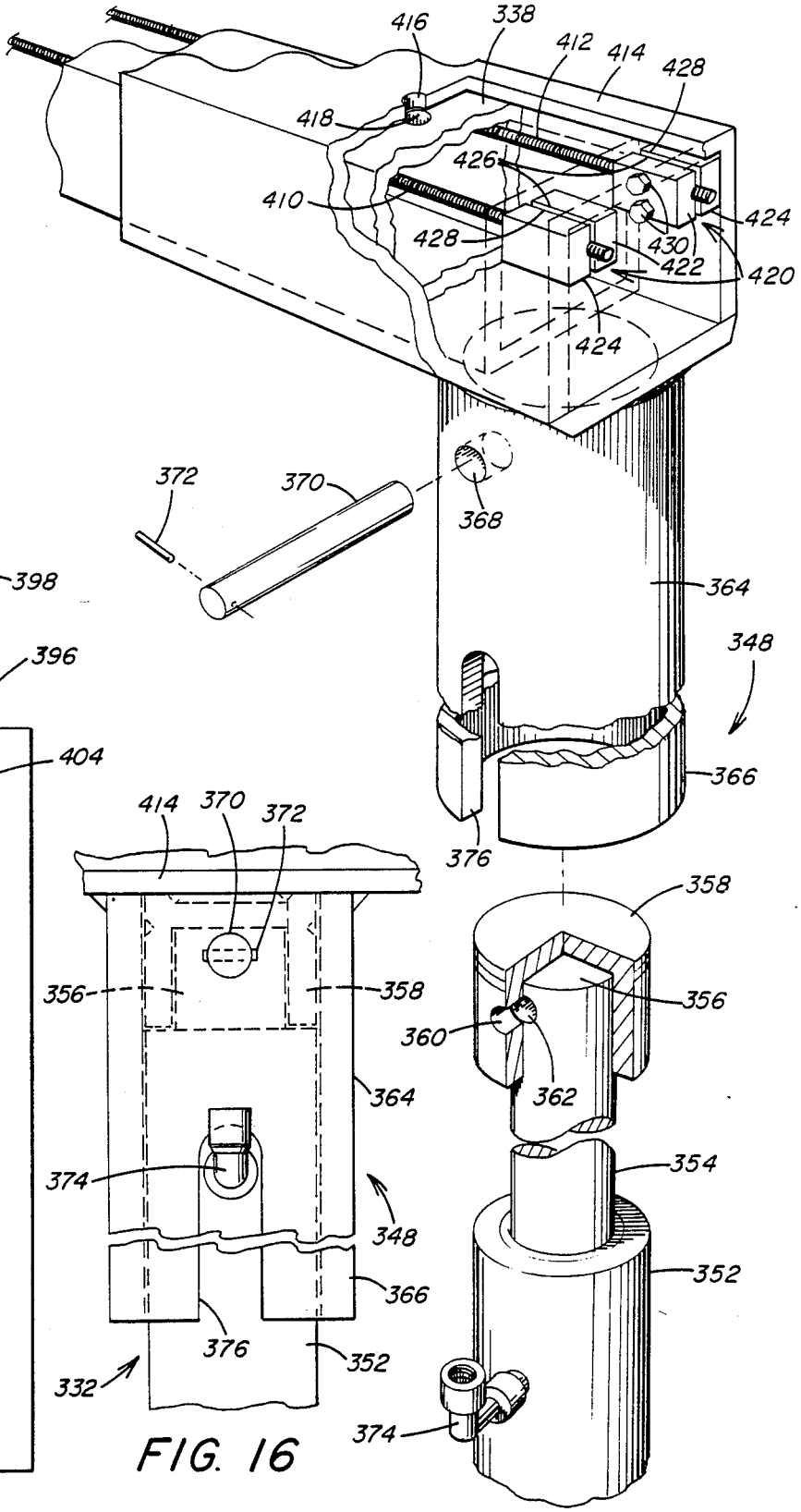
FIG. 15
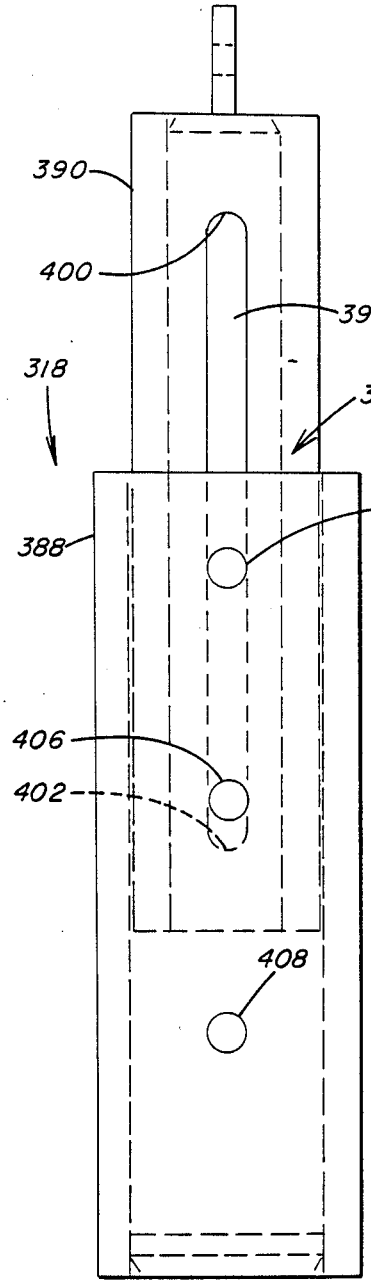
FIG. 14
FIG. 16

MOVABLE ROOF SUPPORT AND BOLTER SYSTEM

BACKGROUND OF THE INVENTION

1. Field of the Invention

This invention relates to a movable or "walking" mine roof support and bolter system and, more particularly, to a plurality of vertically extensible props for supporting spaced apart, transverse roof engaging truss members above a mining machine as it dislodges material from a mine face in which the props are movalbe in both linear and arcuate directions of travel to turn the roof support system around corners as it follows the mining machine during the mining operation.

2. Description of the Prior Art

It is known in underground mining operations to use walking roof supports to provide a mobile tunnel for supporting the mine roof over a continuous mining machine and to advance with the machine. Examples of known walking roof support systems are disclosed in U.S. Pat. Nos. 2,795,936; 3,621,661 and 4,143,991. The walking roof support disclosed in U.S. Pat. No. 2,795,936 includes a pair of laterally spaced elongated roof engaging beams positioned in spaced relation to extend transversely across the mine passageway. Each beam is supported at its end portions by vertically extensible props. The props are positioned adjacent the mine walls, one behind the other. Tandem pairs of props are connected by extensible struts. Each prop includes a floor engaging member in the form of a skid-type foot to be dragged along the mine floor. The struts are angularly movable relative to the props to facilitate turning the roof support system around a corner in a mine passageway.

In the execution of a turn, the strut at one end is locked by a brake mechanism so that extension of the opposite strut angularly moves the opposite prop and the end of the roof beam. A turn is executed with the leading beam lowered from engagement with the mine roof and the trailing beam engaging the roof. The lowered beam is swung through an angle while the other beam remains stationary. After the leading beam is moved, it is raised to engage the mine roof and the trailing beam is lowered. The strut that was extended is now retracted to swing the trailing beam to a position behind the leading beam. Both the leading and trailing beams are walked or advanced straight forward a short distance. The swinging movement of the beams is then repeated several times until the roof support completes the turn around the corner and is ready to move ahead in a new straight line direction.

With the above described arrangement, a plurality of roof support beams are arranged in spaced apart pairs one behind another to form a tunnel of a preselected length to provide temporary roof support above the mining machine. The pairs of beams are independently movable to form the tunnel. Thus, while some of the pairs of beams of the tunnel advance in a straight line direction, other pairs of beams maay be turning a corner. This occurs because all the props, struts and beams are not connected to form an integral roof support system. As a result, the movement of the pairs of beams must be individually controlled, particularly when executing a turn around a corner in the mine passageway.

U.S. Pat. No. 3,621,661 discloses a walking roof support that includes two units, one straddling the other. Each unit includes a pair of spaced apart girders that extend in the direction of travel of the roof support. In use, the girders are positioned adjacent the opposite walls or ribs of the mine passageway. The ends of the girders are mounted on double acting vertically extensible props. A plurality of roof engaging beams are mounted on the girders and extend transversely across the mine passageway. The transverse beams of the first unit overlap the girders of the second unit, and the transverse beams of the second unit overlap the girders of the first unit.

With the above arrangement to advance, for example the first unit relative to the second unit, the props of the first unit are raised out of contact with the mine floor and the beams thereof are lowered onto the girders of the second unit which is supported on the mine floor. The non-supporting unit is then forwardly advanced by operation of rams to a preselected position and reset into engagement with the mine roof and floor. The other unit which was supporting is moved to a non-supporting position and is advanced in the same manner on the other unit which is supporting. In this manner, each unit is progressively advanced as the mining machine operates beneath the girders and beams. Provision is also made for pivotally connecting arms to the props to carry a bar for transversely mounting a drilling machine. Pivoting the arms on the props raises and lowers the bar that carries the drilling machine.

U.S. Pat. No. 4,143,991 discloses a mine roof support system in which a plurality of transversely extending roof engaging beams are supported by vertical props connected to one another by horizontally positioned rams. The props raise and lower the beams into and out of engagement with the mine roof. Selected extension and retraction of the rams are operable to both advance all of the beams as a single unit in a straight line path through the mine passageway above the mining machine or through an arcuate path to turn the roof support around a corner to move with the mining machine from one mine entry into another mine entry.

As above discussed, U.S. Pat. No. 3,621,661 discloses mounting a drilling machine on a walking roof support. It is also well known as disclosed in U.S. Pat. Nos. 3,892,100; 3,995,905; 4,079,792 and Re. 28,556 to utilize drilling machines in combination with movable roof support systems. U.S. Pat. No. 3,892,100 discloses a roof support that is carried on a mining machine to provide temporary roof support above the mining machine. The temporary roof support includes roof engaging beams supported by telescopic jacks. To permit the mining machine to advance, the beams are lowered from contact with the mine roof and the jacks are raised from contact with the mine floor.

A similar arrangement for providing temporary roof support above a mining machine is disclosed in U.S. Pat. No. 3,995,905. Not only does the mining machine include temporary roof supports, but also includes roof bolters spaced on opposite sides of the machine for pivotal movement to drill bolt holes and install roof bolts in the mine roof for permanent roof support. Thus as the mining machine is operating to dislodge material from the mine face, the temporary roof support system supports the mine roof as roof bolts are progressively installed in the mine roof as the mining machine advances.

U.S. Pat. Nos. 4,079,792 and Re. 28,556 are examples of known types of mobile vehicles used in underground mining operations for providing temporary roof support as bolt holes are drilled and roof bolts are installed in a mine roof for permanent roof support.

While it is known to provide walking roof support systems for temporary roof support over a continuous mining machine as material is dislodged from the mine face and to also drill holes and install roof bolts in the mine roof adjacent the mine face as the mining operation is carried out, there is need for a moveable roof support system that is readily adaptable for changing the direction of movement of the roof support as it moves with the mining machine, particularly in executing a right angle turn around a corner from one passageway to another. Not only must the roof support system be easily moved in order to follow the path of the mining machine, but also be adaptable to support one or more roof drills for the installation of roof bolts above the roof support system.

SUMMARY OF THE INVENTION

In accordance with the present invention there is provided a mine roof support system that includes a plurality of truss members each having first and second ends with the trus memebers being positioned in spaced relationship one behind another. A plurality of vertically extensible props each has an upper end portion and a lower end portion and include means for extending and retracting the upper end portion relative to the lower end portion to adjust the vertical height of the props. One of the props is positioned under each of the ends of each truss member. The upper end portion of the prop is connected to a respective end of the truss member so that each truss member is supported by a pair of the props for movement into and out of engagement with a mine roof. There are ground engaging means for supporting each prop at the lower end portion thereof for movement on a mine floor. Connecting means beneath the ends of the truss members are provided for connecting adjacent props in tandem arrangement to permit limited horizontal movement of the truss members and associated props relative to each other. Each ground engaging means includes a selectively operable propulsion unit capable of being operated to provide the horizontal movement of its respective prop and end of the truss members.

Further in accordance with the present invention, there is provided a mine roof support system including a plurality of truss members each having first and second ends with the truss members being positioned in spared relationship one behind another. A plurality of vertically extensible props each has an upper end portion and a lower end portion and includes means for extending and retracting the upper end portion relative to the lower end portion to adjust a vertical height of the prop. One of the props is positioneed under each end of each truss member. The upper end portion of the prop is connected to a respective end of the truss member so that each truss member is supported by a pair of the props for movement into and out of engagement with a mine roof. Ground engaging means is provided for supporting each prop at the lower end portion thereof for movement on a mine floor. Connecting means beneath the ends of the truss members is provided for connecting adjacent props in tandem arrangement to permit horizontal movement of the truss members and associated props relative to each other. Each of the truss members is horizontally expandable to facilitate transportation through a mine prior to being positioned for movement into and out of engagement with the mine roof.

Still further in accordance with the present invention, there is provided a mine roof support beam having an elongated member having opposite end portions. Vertically extensible prop means are connected to each of the end portions of each of the elongated members for raising and lowering the elongated member into and out of position for supporting a mine roof. A major portion of each elongated member is fabricated of reinforced fiberglass and has an elastic limit permitting deformation of the elongated member under load when in contact with the mine roof. The elongated member is movable between a horizontal position and a position deflected from the horizontal position without failure when in an abutting relationship with the mine roof to support the mine roof. The elongated member when deflected to a preselected position provides a warning that the elongated member is approaching the elastic limit prior to failure of the elongated member under a weight of the mine roof.

Yet another feature of the present invention includes a method for temporarily supporting a mine roof that includes the steps of positioning a plurality of truss members in spaced relationship extending substantially across a width of a mine passageway so that the truss members are positioned one behind another. There is the step of supporting first and second end portions of each of the truss members by props positioned on a mine floor for independent vertical movement of each truss member into and out of engagement with the mine roof. The props are connected in tandem relation for movement of the truss members in the mine passageway. Selected truss members are raised into engagement with the mine roof so that the selected truss members are in position for supporting the mine roof. At lest one of the truss members is permitted to move between a horizontal position and a predetermined position deflected downwardly from the horizontal position a preselected distance under a weight of the mine roof without failure of the deflected member. There is the step of indicating approaching failure of the truss members under the weight of the mine roof by the deflected truss member moving toward the preselected distance to provide a warning of collapse of the mine roof above the deflected truss member prior to the collapse of the mine roof.

Still another feature of the present invention includes a mine roof support system including a plurality of truss members each having first and second ends with the truss members being in spaced relationship one behind another. A plurality of vertically extensible props each has an upper end portion and a lower end portion and includes means for extending and retracting the upper end portion relative to the lower end portion to adjust a vertical height of the props. One of the props is positioned under each of the ends of each truss member. There is included connecting means for connecting the upper end portion of the prop to the end of the truss member to resist bending of the prop under a weight of and on the truss member as a pair of the props support the truss member for movement into and out of engagement with a mine roof. There is ground engaging means for supporting each of the props for movement on a mine floor. The connecting means includes a stabilizer sleeve having an upper end connected to the end of the truss member. The stabilizer sleeve extends downwardly from the truss member in surrounding concentric relation with the upper end portion of the prop such that the stabilizer sleeve moves with the upper end portion upon extension and retraction of the upper end portion to raise and lower the truss member. The stabilizer sleeve has a lower end extending below the upper end portion of the prop into the overlying relationship with the lower end portion of the prop. The stabilizer sleeve is slidable on the lower end portion to stabilize the truss member above the prop.

Accordingly, the principal object of the present invention is to provide a movable roof support system that includes a plurality of truss members that extend transversely across a mine passageway and are supported by prop members that are interconnected and movable on the mine floor to form a self-advancing temporary roof support system adjacent the mine face and capable of moving along both linear and arcuate directions of travel in the mine.

Another object of the present invention is to provide a self-advancing roof support system for use in underground mining to provide temporary roof support in a manner permitting movement of machinery beneath the roof support which is movable around corners in the mine passageway.

A further object of the present invention is to provide a movable roof support system of the type described which includes a mine roof support beam which is primarily fabricated of reinforced fiberglass which is capable of being deflected without permanent deformation to serve as a warning prior to failure under a weight of the mine roof.

Yet another object of the present invention includes a method of temporarily supporting a mine roof which includes the step of permitting the deflection of a mine roof support beam to indicate that there may be approaching failure of a truss member.

These and other objects of the present invention will be more completely disclosed and described in the following specification, the accompanying drawings, and the appended claims.

BRIEF DESCRIPTION OF THE DRAWINGS

FIG. 12 is a fragmentary elevational view of adjacent vertical support props including an allernative horizontal connecting means therebetween.

FIG. 13 is a view as seen along line 13—13 of FIG. 12.

FIG. 14 is a view of the horizontal connecting member as seen along line 14—14 of FIG. 12.

FIG. 15 is an exploded fragmentary view of the upper portion of an alaternative prop and an alternative truss member which it is supporting.

FIG. 16 is a fragmentary view of the prop shown in FIG. 15 with the elements thereof assembled.

FIG. 17 is a schematic view of a truss member which extends horizontally under a no load or low load condition.

FIG. 18 is a schematic view like that of FIG. 17 indicating the possible deflection of the truss member while supporting the roof of a mine.

DESCRIPTION OF THE PREFERRED EMBODIMENTS

Figure 1:
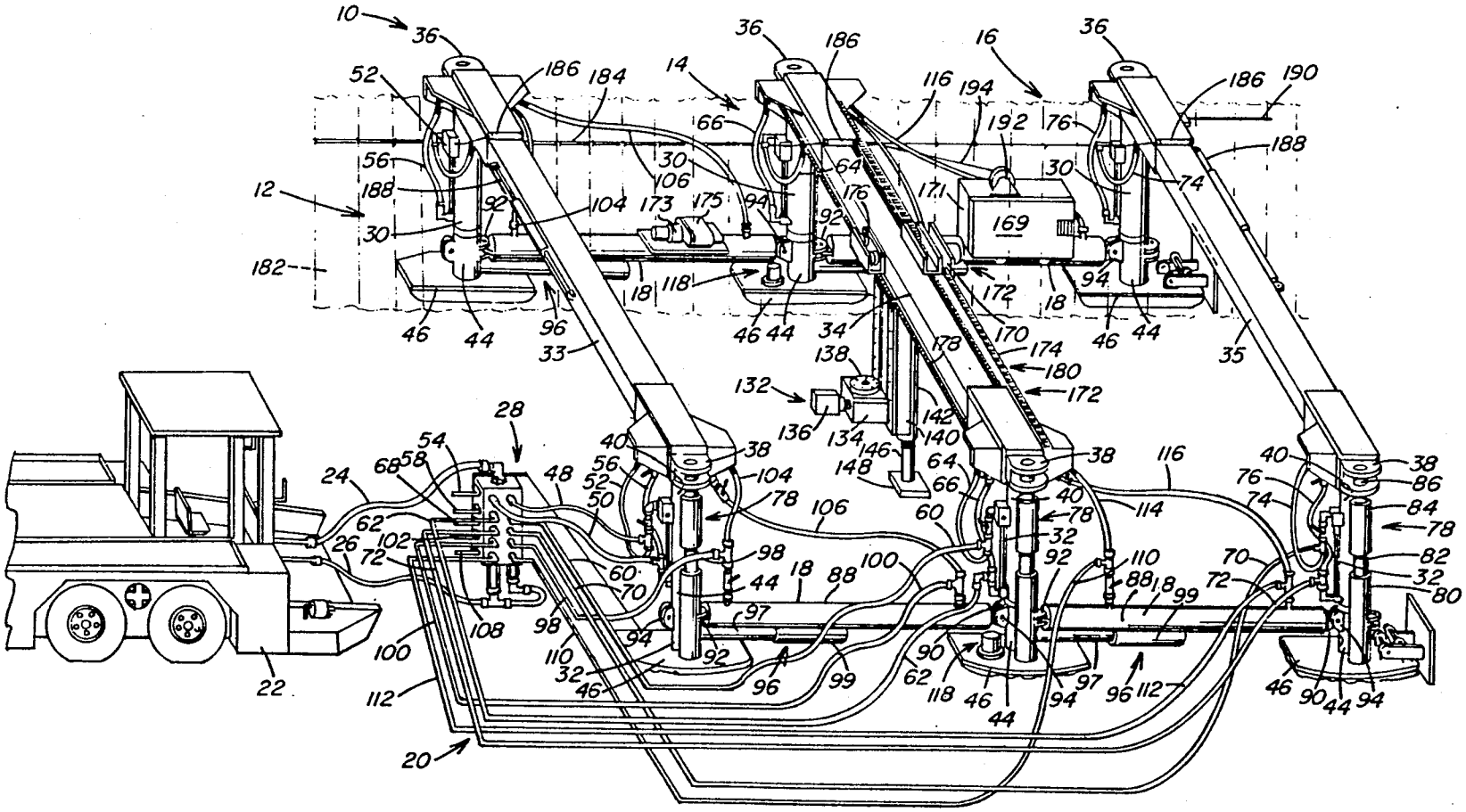
FIG. 1 is an isometric schematic illustration of a movable roof support system for use in underground mining operations, illustrating a plurality of transversely extending truss members vertically and horizontally movable to advance along both a linear and arcuate path and including a roof drilling device supported for movement on a truss member.

Referring to the drawings and particularly to FIG. 1, there is illustrated a mine roof support and bolter system generally designated by the numeral 10 that includes a plurality of movable roof supports generally designated by the numerals 12, 14 and 16 that are innerconnected by hydraulically operated, double acting piston cylinder assemblies 18 for advancing the roof supports along both an arcuate and linear path in a mine passageway in accordance with the present invention. Opposite pairs of piston cylinder assemblies 18 are operable in unison through a hydraulic system generally designated by the numeral 20. Hydraulic fluid under pressure is supplied to the system 20 and therefrom to the cylinder assemblies 18 and the other hydraulically operated devices to be described for operation of the roof supports 12, 14 and 16.

Hydraulic fluid under pressure is provided from a power pack, such as a vehicle 22 illustrated in FIG. 1, positioned remote from the operation of the mine roof support system 10 in the mine. The vehicle 22 is self-propelled to move with the roof support system 10 to supply the power for operating the roof support and bolting operations. The vechicle 22 includes an electric motor and a hydraulic pump connected to the motor. The motor and the pump are connected to a source of hydraulic fluid, such as a tank on the vehicle 22, which is conveyed by a hose 24 to a control valve generally designated by the numeral 28 in FIG. 1. A hose 26 returns the fluid from the valve 28 to the storage tank. Each of the piston cylinder assemblies 18 are, in turn, connected by hoses to the valve 28 to selectively supply fluid under pressure to the cylinders 18 to extend and retract the cylinders 18 to "walk" the roof support system 10.

The details of the hydraulic system 20 and, in particular, the control valve 28 are beyond the scope of the present invention and will not be described in detail. A detailed description of a hydraulic system adaptable for use with the present invention is illustrated and described in U.S. Pat. No. 4,143,991. Therefore, the hydraulic circuitry for the operation of the piston cylinder assemblies 18 and the other hydraulically operated devices on the roof support system 10 will only be described in general terms.

In FIG. 1, three roof support units 12–16 are illustrated. However, it should be understood that more than this number can be utilized, and all of the roof supports are interconnected by the cylinders 18. Preferably, at least two movable roof supports are used to provide temporary roof support above a mining machine, such as a continuous mining machine, and particularly between the area adjacent the mine face and the last section in the mine passageway that is supported by conventional roof support devices, such as roof bolts anchored in the mine roof. Each movable roof support 12–16 includes truss members 33, 34 and 35, respectively; each supported by a pair of vertically extensible props 30 and 32 at its end portions to extend transversely across the mine passageway. The truss members 33–35 are collapsible, i.e., they extend and retract in length transversely across the mine passageway to facilitate movement of the system 10 through the mine passageways to the desired location of operation in the mine.

Each truss member 33–35 has end portions 36 and 38 that are suitably connected to upper end portions 40 of the props 30 and 32. The prop upper end portion is extensible relative to a base portion 44. The base portion 44 of each prop 30 and 32 is supported by a ground engaging shoe 46 which is adaptable for slidable movement on a mine floor.

Each of the props 30 and 32 are operable by actuation of the hydraulic system 20 to extned and retract the prop upper end portion 40 relative to the prop base portion 44 to, in turn, raise and lower the respective roof truss members 33–35. By raising and lowering the truss members 33–35 the truss members are moved into and out of engagement with a mine roof to support the mine roof as a mining machine or any other vehicle is operating in the mine passageway beneath the roof support system 10.

Raising and lowering of the truss members 33–35 is controlled from the control valve 28 by operation of the valves associated with the hydraulic system 20 for controlling the flow of fluid under pressure to and from the pairs of props 30 and 32 for the respective roof truss members 33–35. The props 30 and 32 for each truss member are operated synchronously to provide uniform raising and lowering of the respective truss member. Each pair of props 30 and 32 is individually operated from the flow control device and is connected thereto by a flexible hose.

The trailing truss member 33 is raised and lowered by props 30 and 32 which are connected to the valve 28 by a pair of hoses 48 and 50. Hose 48 is connected by a fitting to the upper end portion of the prop 32, which also is connected to a hose 52 connected to the upper end portion of the opposite prop 30. By movement of a control handle 54 on the valve 28 to a first position, fluid under pressure is directed from the valve 28 to the hoses 48 and 52 to retract the upper end portion 40 of each prop to lower the truss member 33. Similarly, the hose 50 connected to the prop base portion 44 is also connected to a hose 56 which extends to the base portion 44 of the opposite prop 30.

Accordingly, movement of the control handle 54 to a second position on the valve 28 terminates flow through the hose 48 and directs the fluid flow through the hoses 50 and 56 to extend the props 30 and 32 to raise the truss member 33. Thus, movement of the control handle 54 to selected positions controls the flow of fluid through the hoses 48 and 50 to control the extension and retraction of the props 30 and 32 and movement of the truss member 33 into and out of engagement with the mine roof. The hoses 52 and 56 are supported by the truss member 33 as they extend from the prop 32 on one side to the prop 30 on the other side of the roof support system 10.

The pairs of props 30 and 32 for the intermediate truss member 34 and the leading truss member 35 are similarly raised and lowered in the manner as above described for the truss member 33. A valve control handle 58 controls the flow of fluid to either conduit 60 to lower the truss 34 or through hose 62 to raise the truss 34. The hose 60 is connected by a fitting to a hose 64 which extends along the truss member 34 for connection to the upper end portion 40 of the opposite prop 30. Similarly, the hose 62 for supplying hydraulic fluid to the base portion 44 of the prop 32 to raise the prop 32 is connected by a fitting to a hose 66 which also extends on the truss member 34 for connection to the base portion 44 of the opposite prop 30.

The props 30 and 32 for the leading roof truss member 35 are raised and lowered by operation of a control handle 68 on the valve 28 for movement to a selecated position for controlling the flow of fluid under pressure through hoses 70 and 72. The hose 70 is connected by a fitting to a hose 74. Both hoses 70 and 74 are connected to the upper end portions 40 of the corresponding props 30 and 32 for the truss member 35. Flow of fluid through the hoses 70 and 74 retracts the props 30 and 32 to lower the truss member 35. Accordingly, the hose 72 is connected to the base portion 44 of prop 33 and also to a hose 76 which is connected to the base portion 44 of the opposite prop 30. Movement of the control handle 68 to the selected position to divert the fluid flow from hose 70 to hose 72 and hose 76 extends the props 30 and 32 to raise the truss member 35. The hoses 74 and 76 are also supported by the truss member 35 to extend from the prop 32 to the prop 30.

Preferably, the respective pairs of props 30 and 32 for the truss member 33–35 are positioned closely adjacent the walls or ribs of the mine passageway. The props 30 on one side of the mine passageway are spaced one behind the other, and the props 32 on the opposite side are spaced in tandem relation one behind the other. The truss members 33–35 extend substantially the width of the mine passageway and are positioned at a preselected height as determined by the mining operation. The truss members 33–35 are movable through a substantially vertical height to adjust for a variety of mine roof heights, i.e. either in low coal or high coal seams.

The respective pairs of props 30 and 32 are individually operable from the power pack 22 remotely of their location at the flow control valve 28. With this arrangement the power pack 22 and the control valve 28 can be located in the section of the mine having permanent roof support. Thus the roof support and bolter system 10 can be controlled from a position remote from where the temporary roof support is required.

As illustrated in FIG. 1, each prop 30 and 32 is associated with a guide and stabilizer mechanism generally designated by the numeral 78. Only the mechanism 78 for the props 32 are shown in FIG. 1. It should be understood that the same arrangement is provided for each of the props 30.

Figure 6:
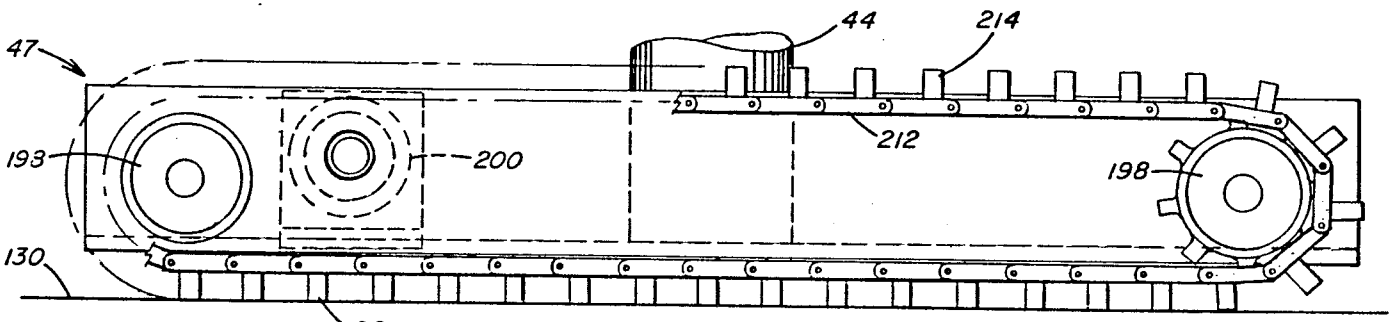
FIGS. 6–7A are enlarged schematic, fragmentary views of crawler supports for moveably supporting the props of the roof support system.
Figure 7:
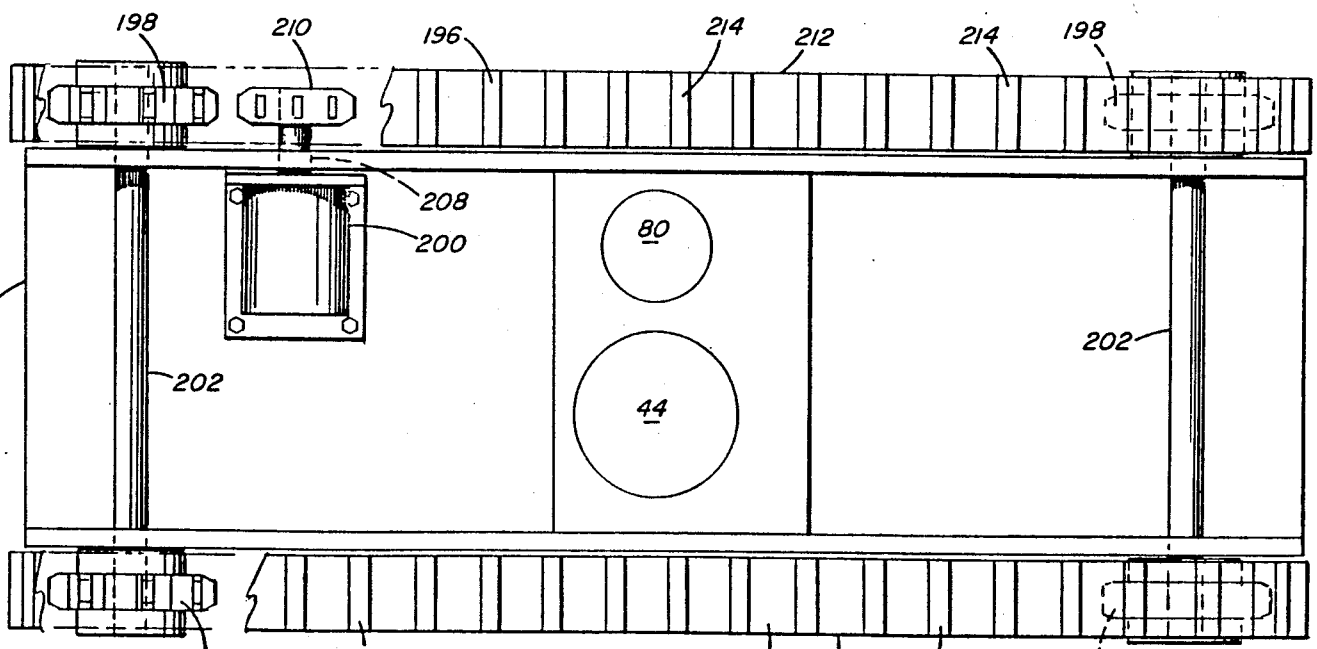

Each mechanism 78 is mounted on the prop ground engaging shoe 46, or in the alternative as shown in FIG. 6 and 7 on driven crawlers 47, and is connected at an upper end portion to the end portions 36 and 38 of the respective truss members. Each of the mechanisms 78 includes a tubular member 80 mounted on the base portion 44. Extending upwardly out of the tubular member 80 is a stabilizer bar 82 which extends through another tubular member 84. Preferably the tubular member 84 is secured as by welding to the respective props 30 and 32. The stabilizer bar 82 includes an upper end portion 86 which extends through guide holes provided in the respective end portions 36 and 38 of the trusses 33–35. The bar end portions 86 are connected to the truss end portions 36 and 38, such as by welding.

The stabilizer bars 82 are movable upwardly and downwardly with the trusses 33–35. The lower ends of the bars 82 are movable in the tubular members 80 which are secured to the shoes 46. Thus with this arrangement the stabilizer bars 82 serve to take the strain off the props 30 and 32 as they are moved up and down. When the truss members 33–35 are moved into engagement with the mine roof, the bars 82 stabilize the truss members and absorb twisting or bending forces which would otherwise be transmitted to the props 30 and 32.

As illustrated in FIG. 1, the piston cylinder assemblies or hydraulic rams 18 interconnect the props 30 and 32 at the respective end portions 36 and 38 of the truss members 33–35. This arrangement permits each of the truss members to be independently advanced relative to the other truss members. Each assembly 18 includes a cylinder portion 88 and an extensible portion 90 movable into and out of the cylinder portion. The piston cylinder assemblies 18 connect adjacent an adjacent set of props 30 and 32. The assemblies are shown fully retracted in FIG. 1. The cylinder portions 88 are connected by brackets 92 to the prop base portions 44 and the extensible portions 90 are also connected by brackets 94 to the adjacent props.

As illustrated in FIG. 1, the set of props 30 and 32 supporting the intermediate truss member 34 supports both brackets 92 and 94 for connection on one side of the props to the extensible portion 90 of an assembly 18 and, at the other side of the prop, for connection to the cylinder portion 88 of an assembly 18. Stabilizers 96 are also provided for connecting the assemblies 18 to one of the adjacent prop members for the purpose of taking the strain off the piston cylinder assemblies 18. The stabilizers 96 each include a rod 97 extending from the respective props 30 and 32 and secured in a cylinder retainer 99 which is connected in underlying relation to the assemblies 18. The stabilizer rod 97 is movably retained in a bore of the prop bore 44 for stabilizing the assembly 18 in a horizontal plane.

Hydraulic fluid under pressure is selectively supplied to the assemblies 18 from the flow control valve 28 to advance the mine roof support and bolter system 10 in the mine passageway. Hydraulic fluid for the operation of the piston cylinder assemblies 18 located between the trailing truss member 33 and the intermediate truss 34 is conveyed from the valve 28 through hoses 98 and 100. The assemblies 18 are double acting and the control of fluid through the hoses 98 and 100 controls the extension and retraction of the assemblies 18.

A control handle 102 is movable to a preselected position for directing fluid through the hose 98 to extend the extensible portion 90 relative to the cylinder portion 88. The hose 98 is connected by a fitting to a hose 104 which also extends across the truss member 33 to the end portion 18 associated with the opposite prop 30. Retraction of the extensible portion 90 into the cylinder portion 88 is accomplished by moving the control handle 102 to a second position to direct fluid through the hose 100. The hose 100 is positioned adjacent the cylinder portion 88 from which the extensible portion 90 is advanced. The hose 100 is also connected by a fitting to a hose 106 which extends across the truss member 33 for retracting the extensible portion 90 that is connected to the opposite prop 30. Thus, movement of the control handle 102 to a selected position directs fluid either to the hose 98 or hose 100 to operate the piston cylinder assemblies 18 and advance the truss members 33 and 34.

Accordingly, movement of the leading truss member 35 relative to the intermediate truss member 34 is accomplished by movement of a control handle 108 to direct the flow of fluid under pressure to either a hose 110 or a hose 112. The hose 110 is connected to the cylinder portion 88 of the assemblies 18 for moving the leading truss member 35 relative to the intermediate truss member 34. The hose 110 is connected by a fitting to a hose 114 which extends across the truss member 34 for connection to the cylinder portion 88 of the assembly 18 that extends between the trusses 34 and 35.

Movement of the control handle 108 to a second position on the housing 28 directs fluid through the hose 112, which is connected to the forward end of the cylinder portion 88 from which the extensible portion 90 extends. The hose 112 is connected by the fitting to a hose 116 which also extends across the truss member 34 for connection at the front of the opposite cylinder portion 88. Directing fluid through hose 116 retracts the extensible portion 90 connected to the prop 30 below the leading truss member 35.

As illustrated in FIG. 1 the piston cylinder assemblies 18 are in the fully retracted position. To advance the mine roof support system 10 forwardly in the mine passageway toward the mine face, the leading truss member 35 which is closest to the mine face is lowered from engagement with the mine roof. The piston cylinder assemblies 18 extending between the truss members 34 and 35 are then actuated to extend the extensible portion 90 to forwardly advance the truss member 35 while the truss members 33 and 34 remain stationary. Preferably, at least one of the truss members 33 and 34 remains in engagement with the mine roof as the truss member 35 is forwardly advanced.

The truss member 35 is advanced a preselected distance, for example two feet. Thereafter the piston cylinder assemblies 18 between the truss members 33 and 34 are actuated to forwardly advance the truss member 34 toward the truss member 35. During this movement the assemblies 18 associated with the truss member 35 are permitted to retract while the assemblies 18 between the truss members 33 and 34 extend. In the alternative the assemblies 18 associated with the truss member 35 can be retracted to forwardly advance truss member 34.

To advance the trailing truss member 33 forwardly in the mine passageway, the truss member 35 is raised into engagement with the mine roof, and the truss member 34 is maintained out of engagement with the mine roof. The piston cylinder assemblies 18 between the truss members 33 and 35 are retracted to draw forwardly the truss member 33. During this movement the extensible portions 90 move into the cylinder portions 88, thereby moving the trailing truss member 33 forwardly an increment of two feet. The above sequence of extension and retraction of the respective piston cylinder assemblies 18 is repeated to progressively advance the truss members 33–35 in a linear path in the mine passageway.

In accordance with the present invention, not only is the mine roof support and bolter system 10 operable for advancement in a mine shaft in a linear path, but is also movable in an arcuate path so as to permit the roof support system 10 to turn a corner in a mine passageway and follow the mining machine from one entry into another which is perpendicular to the first. This occurs, for example, as the mining machine is continuously advancing the mine face to the point where the mine face breaks through into an entry which is perpendicular to the direction of travel of the mining machine. Once the mining machine breaks through to intersect the entry, the mining machine turns to progress down the entry.

In accordance with the present invention, the mine roof support and bolter system 10 is operable to follow the travel of the mining machine to turn the corner at an angle of 90° and follow the mining machine through the breakthrough and down the entry. Thus the system 10 is operable to change its direction of travel from a linear path to an arcuate path in order to execute the 90° turn. Once the mine roof support and bolter system 10 has reached the point of the breakthrough, the system 10 is advanced into the intersecting entry so that leading truss member 35 is in the new entry. The intermediate truss member 34 is also in the new entry approximately at the point of intersection of the old entry and the new entry with the trailing truss member 33 positioned in the old entry. Once the roof support system 10 is in this position the props 30 and 32 are turned to advance the truss members 33–35 in an arcuate path. This is accomplished by advancing the props on one side while maintaining the props fixed on the opposite side.

For example, in the execution of a 90° left turn for the roof support and bolter system 10 illustrated in FIG. 1, the right side props 32 are advanced through an arcuate path to pivot relative to the left side props which remain fixed to rotate about a pivot point. To facilitate the turning of the roof support system 10 through an arcuate path of any angle, the prop ground engaging shoes 46 are provided with a raise jack generally designated by the numberal 118 in FIGS. 1, 4 and 5. The raise jack 118 is also a hydraulically operated device controlled from the valve 28 of the hydraulic system 20. The hydraulic fittings for the jack 118 shown in FIGS. 1, 4 and 5 have been omitted for the purpose of clarity. The jack 118 shown in FIG. 5 is representative of all of the raise jacks. As illustrated in FIG. 1, the props 30 and 32 supporting the intermediate truss member 34 is provided with a raise jack 118.

Figure 4:
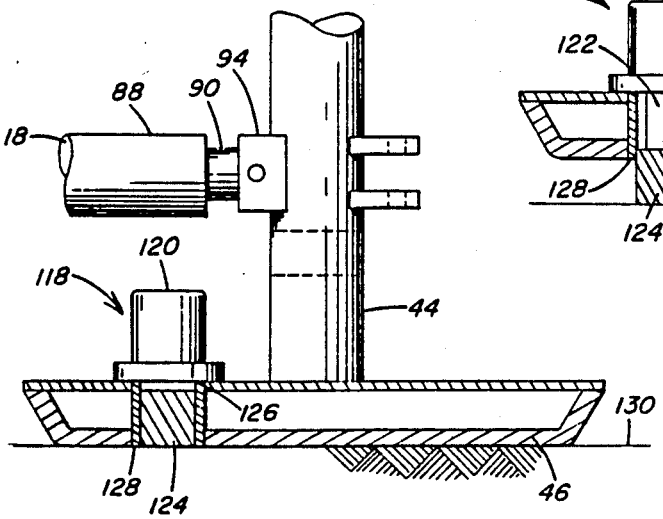
FIG. 4 is an enlarged fragmentary schematic illustration of a ground engaging device for supporting one of the props of the roof support system, illustrating a raise jack for raising the ground engaging device from contact with the mine floor.
Figure 5:
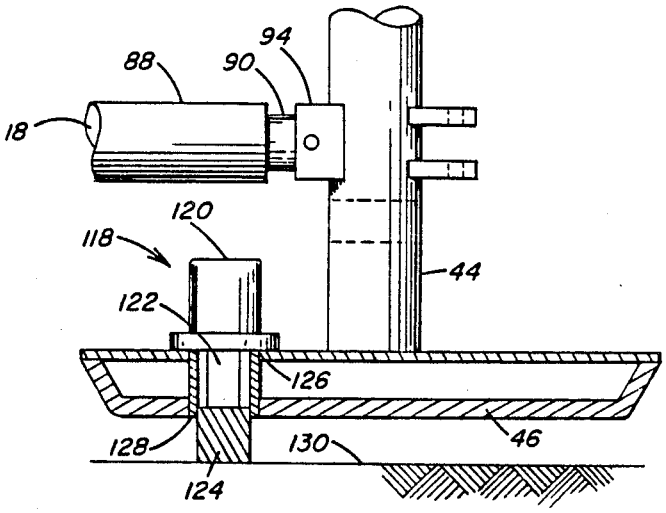
FIG. 5 is a view similar to FIG. 4, illustrating the raise jack extended to raise the prop from contact with the mine floor for pivotal movement of the prop about the raise jack in execution of a turn of the roof support system in a mine passageway.

As illustrated in FIGS. 4 and 5, each raise jack 118 includes a cylinder housing 120 containing an extensible and retractable piston 122 having a foot portion 124. The prop shoe 46 includes an opening 126 over which the housing 120 is positioned in its mounting on the shoe 46. The piston 122 extends downwardly through a sleeve 128 provided in the opening 126 for guiding the upward and downward movement of the piston. 122. The piston 122 is of the double acting type and includes means for supplying fluid under pressure to opposite ends of the piston to extend the piston 122 from the bottom of the shoe 46. As illustrated in FIG. 5, when the foot 124 is extended downwardly from the bottom of the shoe 46, the shoe 46 is raised to an elevated position, for example a couple of inches above the mine floor 130.

Accordingly, by removing the fluid pressure against one side of the piston 122 and directing it to the other side of the piston, the piston 122 is retracted into the cylinder housing 120. The foot portion 124 moves upwardly within the sleeve 128 as shown in FIG. 4. In the extended position, as illustrated in FIG. 5, the foot portion 124 extends below the sleeve 128. In the retracted position of the piston 122, the foot portion 124 is fully retracted into the sleeve 128 so that substantially the entire surface of the shoe 46 rests on the mine floor 130.

With the above described arrangement, for a raise jack 118 provided on the shoes 46 for the respective props 30 and 32 that support the intermediate truss member 34, operation of the jack 118 to extend the piston 122 not only raises the shoe 46 of the prop 32 from contact with the mine floor but also raises the prop 30 supporting the end of the trailing truss member 33 and the prop 30 supporting the leading truss member 35 from contact with the mine floor. The remaining shoes 46 on the other side below the trusses 33–35 remain in contact with the mine floor. With this arrangement all of the props on the one side of the truss members are raised out of contact with the ground and the only contact therewith is by engagement of the extended foot portion 124 with the mine floor 130, as shown in FIG. 5.

In operation with the props 30 raised from contact with the mine floor 130 by extension of the raise jack 118, the piston cylinder assemblies 18 associated with the props 30 remain fully retracted. The intermediate and trailing truss members 33 and 35 are removed from engagement with the mine roof. The leading truss member 35 is in engagement with the mine roof or the truss end portion 36 can be lowered from contact with the mine roof. The flow of hydraulic fluid to the piston cylinder assemblies 18 associated with the props 30 is terminated while fluid is supplied to the piston cylinder assemblies 18 in a manner to forwardly advance the props 32 that support the trailing and intermediate truss members 33 and 34.

The prop 32 supporting the leading truss member 35 remains stationary. Consequently, the truss members 33 and 34 advance upon operation of the piston cylinder assemblies 18 by pivotal movement about the raise jack 118. In this manner the entire roof support system 10 pivots through a first portion of the angular movement to complete the 90° turn to the left. Upon a two foot advancement of the props 32 that support the truss members 33 and 34, the leading truss member 35 is retracted and the trailing truss member 33 is extended into engagement with the mine roof. The operation is repeated to pivot the props 32 associated with the truss members 34 and 35. Thus as the piston cylinder assemblies 118 are actuated to pivotally advance the truss members 34 and 35 the assemblies 18 on the opposite side remain inactive so as to complete the pivotal movement of the entire system 10 about the pivot point formed by contact of the foot portion 124 extended into contact with the mine floor, as illustrated in FIG. 5.

The pivoting movement can be initiated from either the leading truss 35 or the trailing truss 33; i.e. the leading truss 35 can be fixed and the other trusses 33 and 34 turned or the trailing truss 33 can be fixed and the other trusses 34 and 35 turned. The turning operation is continuous in an arcuate path for a left 90° turn in FIG. 1 whereby the props 30 remain stationary while the props 32 are swung through an arc. Once the system 10 has been repositioned for linear advancement in the new entry, the piston cylinder assemblies 18 are again operated in pairs opposite one another to linearly advance the props 30 and 32.

As the mining machine dislodges material from the mine face, the dislodged material is conveyed rearwardly from the mine face beneath the roof support system 10 into a haulage vehicle or onto any other suitable conveying means for transportation of the material from the mine. Simultaneous with material dislodging and removal operations, one or more roof drilling units generally designated by the numeral 132 in FIG. 1 are operable on the system 10 to drill bolt holes and install roof bolts in the mine roof. The system 10 provides temporary roof support above the mining machine as the mine material is being continuously dislodged and conveyed rearwardly from the mine face. The installation of roof bolts in the mine roof provides permanent roof support. Thus as the system 10 advances, the mine roof behind the support system 10 is permanently supported by roof bolts.

The roof truss members 33–35 support the mine roof not only during the operation of the mining machine at the mine face, but also during the roof drilling and bolting operations. By carrying the roof drilling units 132 on the movable system 10, roof drilling and bolting operations can be conducted in close proximity to the continuous mining machine. The roof drilling and bolting operations are conducted when the system 10 is not advancing.

Figure 2:
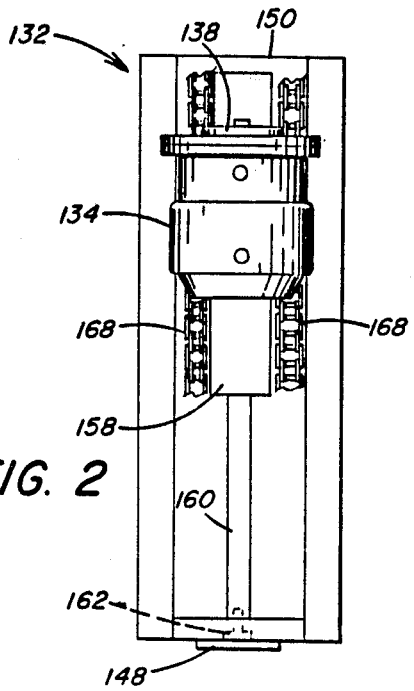
FIG. 2 is an enlarged fragmentary front view of a mast-type roof drilling machine mounted on the truss member shown in FIG. 1.
Figure 3:
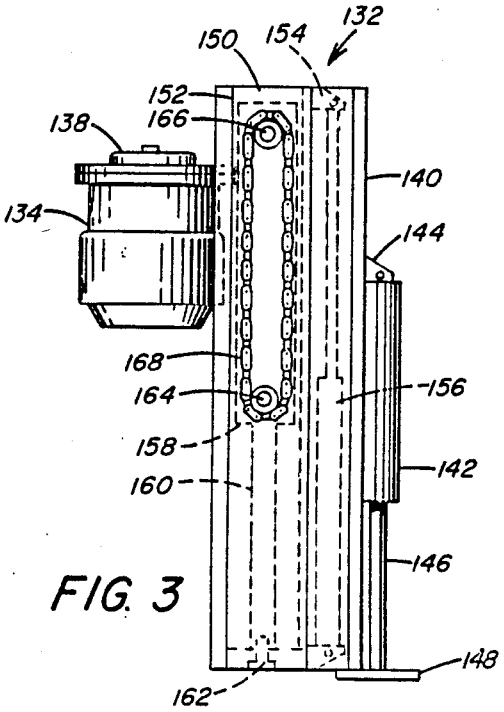
FIG. 3 is a view in side elevation of the roof drilling machine shown in FIG. 2.

As illustrated in FIG. 1, a roof drilling unit 132 is shown mounted for movement to a desired location along the length of the intermediate roof truss member 34. However, it should also be understood that the other truss members 33 and 35 can also carry roof drilling units for movement to selected locations along the length thereof for spacing the bolt holes and roof bolts in a line transversely in the mine roof from rib to rib. The roof drilling unit 132 shown in FIG. 1 and in further detail in FIGS. 2 and 3 is a mast-type roof drill and bolter that includes a drill pot 134 driven by a suitable motor, such as a hydraulic motor 136 shown in FIG. 1. The hydraulic circuitry for the motor 136 has been deleted for purposes of clarity of illustration but is conventional. The motor 136 is hydraulically connected to the control valve 28.

The motor 136 is drivingly connected to a drill chuck 138 rotatably mounted within the drill pot 134. Rotation is transmitted from the motor 136 to the drill chuck 138 to rotate a drill rod (not shown) that is retained within the drill chuck 138. The drill rod carries a drill steel operable to drill a bore hole in the mine roof. Both wet and dry bore hole drilling are performed by the roof drilling unit 132, and the unit 132 is adaptable to both types of drilling.

The roof drilling unit 132 is mounted for vertical movement on a telescoping mast 140. A floor jack 142 is connected to a bracket 144 of the mast 140. The floor jack 142 includes an extensible piston 146 connected to a bearing plate 148 that is movable into and out of engagement with the mine floor to brace the mast 140 and roof drilling unit 132 during the roof drilling and bolting operations. The hydraulic cylinder 142 is double acting so that with the mast 140 secured to the roof truss member 33 in a manner to be explained later in greater detail, extension and retraction of the piston 146 moves the bearing plate 148 into and out of engagement with the mine floor. With this arrangement the roof drilling unit 132 is carried by the truss member 34. Accordingly during movement of the truss member 34, the piston 146 is retracted to raise the bearing plate 148 out of contact with the mine floor to permit the entire drilling unit 132 to move with the truss member 34. During both the roof drilling and bolting operations the piston 146 is extended to engage the plate 148 into contact with the mine floor to brace the drilling unit 132.

As illustrated in FIG. 3, the telescoping mast 140 includes a carriage 150 that is supported for vertical movement within a guideway 152 of the mast 140. The carriage 150 is connected by a bracket 154 to the upper end portion of a telescoping jack 156 that is mounted on the mast 140. The telescoping jack 156 is vertically positioned so that upon actuation of the jack 156, the carriage 150 is raised and lowered on the mast 140.

The drill pot 134 is mounted for vertical movement on the carriage 150. The carriage 150 supports a vertical lift jack 158 having a rod portion 160 secured by a fastener 162 to the carriage 150. The lift jack 158 moves relative to the rod portion 160. Pairs of sprockets 164 and 166 are mounted on the lift jack 158 and are connected by chains 168. A selected one of the sprocket pairs 164 and 166 is driven by suitable means so that the chains 168 are rotated on the carriage 150.

The drill pot 134 is suitably mounted on the chains 168 and guided for vertical movement on the carriage 150. Suitable hydraulically driven motor means (not shown) connected to one of the sprocket pairs rotates the chains 168 to, in turn, raise and lower the drill pot 134 through a vertical height equal to the spacing between the sprockets 158 and 160. Thus with this arrangement, the drill pot 134 is vertically movable in at least three stages. The carriage 150 for the drill pot 134 is vertically movable by operation of the telescoping jack 156 on the mast 140. The lift jack 158 that carries the drill pot 134 is vertically movable on the carriage 150. The drill pot 134 by rotation of the chains 168 is vertically movable on the lift jack 158.

When a drill rod is positioned in the drill chuck 138, the drill pot 134 is raised on the mast 140 to advance the rotating drill rod into the roof strata. Once a bore hole has been drilled to a preselected depth into the mine roof, the drill rod is retracted by lowering the drill pot 134 on the mast 140. The drill rod is then removed from the chuck 138 and replaced with a roof bolt assembly. The drill pot 134 is then vertically raised on the mast 140 to install the roof bolt assembly in the bore hole.

Once a bore hole has been drilled and a roof bolt installed in the mine roof, the roof drilling unit 132 is moved on the truss member 34 for drilling a bore hole and installing a roof bolt a preselected distance spaced from the previously installed roof bolt. In this manner the roof drilling unit 132 is progressively moved along the length of the roof truss 34 from a position adjacent one rib to a position adjacent the opposite rib for installing a preselected number of roof bolts spaced in a straight line across the mine roof from rib to rib. The hydraulic circuitry for controlling both the vertical and transverse movement of the drill pot 134 on one or more of the truss members is connected to the control valve 28. This arrangement permits remote operation of the drilling unit 132. The details of the hydraulic connections have been omitted from FIG. 1 for clarity and are beyond the scope of the present invention.

Provision is also made on the system 10 for collection of dust generated during the bolt hole drilling operations. As shown in FIG. 1, a dust collector 169 is mounted on the cylinder assembly 18 to the rear of the prop 30 that supports the leading truss member 35. The dust collector 169 includes a case 171 having a dust intake (not shown) connected by a hose to the drill pot 134. Dust and rock cuttings are conveyed by a vacuum system down through the drill rod and the drill pot 134 through a hose into the dust intake of the case 171. In the case 171 an air filter device separates the dust from the air flow, and the filtered air is discharged back into the atmosphere. The vacuum system of the dust collector 169 is powered by a hydraulic motor 173 connected to a blower motor 175 mounted on the cylinder assembly 18 to the rear of the prop 30 supporting the truss member 34 as shown in FIG. 1. The blower motor 175 is connected by conduit means to the dust collector case 171 to generate the air flow for drawing the dust and cuttings from the drill pot 134. The hydraulic motor 173 is also controlled by the control valve 28.

The apparatus for moving the drilling unit 132 along the length of the intermediate roof truss member 34 is shown in FIG. 1. The mast 140 shown in detail in FIGS. 2 and 3 is connected to a frame 170 which is supported for movement along the length of the truss member 34. The frame 170 is movable along the length of the truss member 34 by operation of a hydraulic motor, generally designated by the numeral 172 in FIG. 1. The motor 172 drives a sprocket in either a clockwise or counterclockwise direction. The sprocket (not shown) is rotatably mounted on the frame 170. The sprocket engages a chain 174 which is secured at its end portions to the end portions 36 and 38 of the truss member 34. The sprocket rotates on the chain 174. The frame 170 also includes rotatable idler rollers 176 positioned on both sides of the truss member 34. The idler rollers 176 are rotatable on a pair of bars 178 that are secured to and extend the length of the truss member 34. With this arrangement the frame 170 is movable by rotation of the rollers 176 on the bars 178 as the sprocket of the motor 172 rotates in a preselected direction on the chain 174 to advance the roof drilling unit 132 along the length of the truss member 34 between the props 30 and 32.

Roof drilling units 132 can also be mounted on the other trusses 33 and 35 in the same manner as above described for the truss member 34. With this arrangement, bolt holes are drilled and roof bolts are installed in the mine roof in accordance with a predetermined pattern to provide permanent roof support in close proximity to the mine face.

Not only is the roof support and bolter system 10 operable with such devices as a roof drilling unit, an air filter, etc., it is also operable as a means for hanging a permanent ventilation curtain in a mine passageway and move a temporary ventilation curtain with it. A ventilation curtain 182 is illustrated in phantom in FIG. 1 for movement with the system 10. Ventilation curtains are well known in the art as a means for supplying filtered air to the mine face and to ventilate the mine face during the material dislodging operation. The curtain 182 is movable with the system 10 and is preferably supported underneath the ends 36 of the truss members 33–35 so that the props 30 are positioned between the curtain 182 and the mine rib. With this arrangement the curtain 182 is spaced from the mine rib to provide a channel for the flow of ventilation air to the mine face. The curtain 182 is hung by hooks on a flexible guide line 184 which extends through tubes 186 which are secured to the top surfaces of the truss members 33–35. The ends of guide line 184 are connected to spring devices 188 which keep the guide lines 184 under tension as the truss members 33–35 advance. As the truss members 33–35 advance the curtain 182 also moves in a folding and unfolding manner. A portion of curtain 182 extends forwardly of the leading truss member 35 and is supported by a rod 190 that extends forwardly from the truss member 35.

Provision is also made on the system 10 for permanently installing a ventilation curtain on the roof plates of the roof bolter anchored in the mine roof. This is accomplished by mounting a reel 192 of guide line 194 on the moving support system 10 such as on the case 171, as shown in FIG. 1. The free end of the guide line 194 extends from the reel 192 onto the truss 34 where it is suitably retained. The guide line 194 extends upwardly into engagement with an installed roof plate. Thus as the system 10 advances, the line 194 is threaded from one roof plate to the next forward roof plate. The guide line 194 is permanently positioned to extend from roof plate to roof plate and serve as a means for permanently hanging a ventilation curtain behind the system 10 as it advances. The curtain hung in this manner remains in place while the curtain 182 shown in FIG. 1 moves with the support system 10.

Figure 7A:
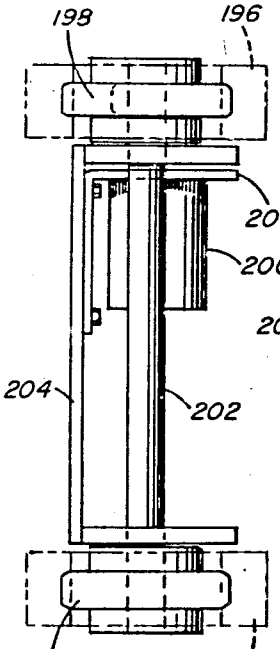

Now referring to FIGS. 6, 7, and 7A, there is illustrated the crawler generally designated by the numeral 47. A plurality of the crawlers 47 are adaptable for use to support the props 30 and 32 and the overhead truss members 33–35 for advancement of the entire system 10 on the mine floor 130. The crawlers 47 are used as an alternative to the ground engaging shoes 46 above described. One of the principal features of the crawlers 47 is driven crawler tracks 196. A pair of driven crawler tracks 196 are reeved about driven sprockets 198. The crawler tracks 196 engage the teeth of the sprockets 198. The sprockets are connected to each other by rotatable shafts 202 mounted in a U-shaped frame 204. A motor 200 is adjustably mounted on the frame 204 by an adjusting bracket 206. The motor 200 includes a drive shaft 208 connected to a drive sprocket 210. The teeth of the drive sprocket 210 engage a chain 212 which forms part of each crawler track 196. Suitably connected to the chain 212 in spaced relation are a plurality of crawler pads 214, shown in FIGS. 6 and 7.

Also shown in FIGS. 6 and 7 is a portion of the base portion 44 of the respective props 30, 32 and the tubular member 80 which is the base of the stabilizer and guide mechanism 78. The crawlers 47 securely support the props 30, 32 and the stabilizer and guide mechanisms 78. With this arrangement and particularly when the floor conditions in a mine are not suitable for use of the base portion 44 for sliding movement thereon, the crawlers 47 with the crawler tracks 196 when driven by the motor 200 propel the entire mine roof and bolter system 10 in the mine. An identical crawler 47 has been incorporated in an alternative embodiment of FIGS. 11, 12, 13, and 14 and will be further discussed in detail hereinbelow.

Figure 8:
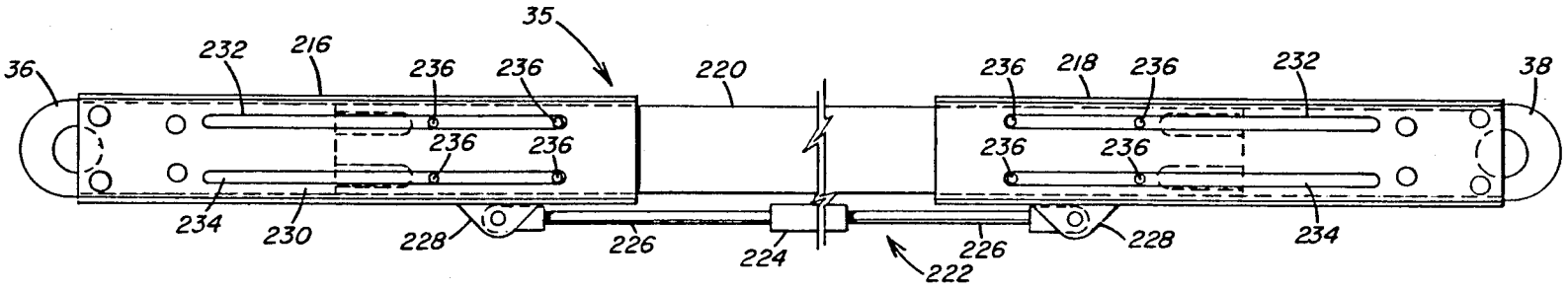
FIGS. 8–10 are enlarged schematic, fragmentary views of an extensible and retractable truss member, illustrating in FIG. 10 a dust suppression device and lights mounted on the front of the truss member.
Figure 9:
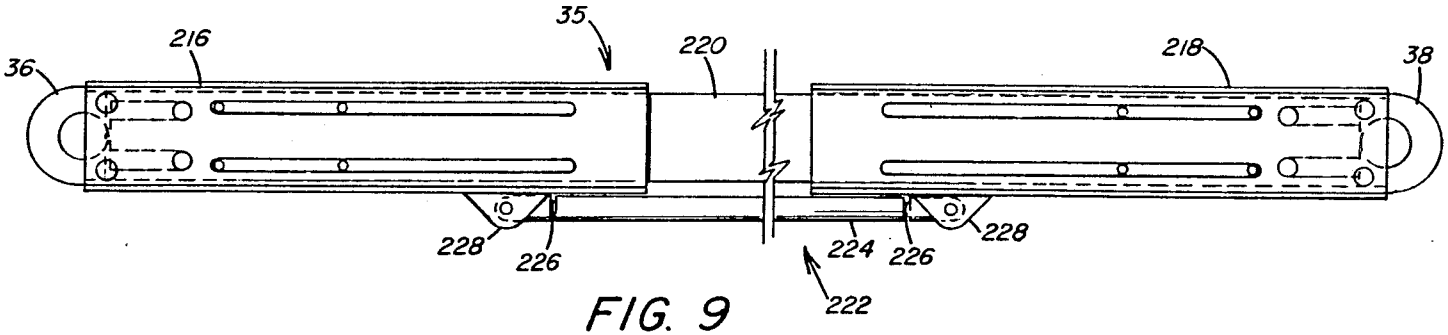
Figure 10:
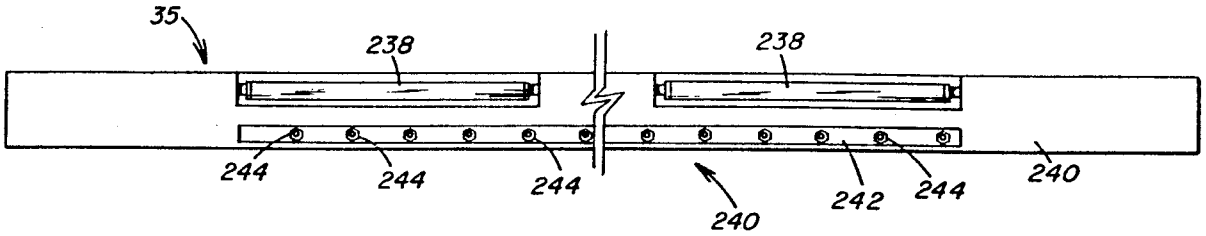

Now referring to FIGS. 8–10 there is illustrated an example of a truss member and particularly the leading truss member 35 shown in FIG. 1. It should be understood, however, that the truss member 35 shown in FIGS. 8–10 is also representative of the construction of the other truss members 33 and 34. All the truss members 33–35 are collapsible so as to permit the length to be adjusted to accommodate within a range the width of the mine passageway through which the system 10 travels. Also by providing collapsible truss members when all the truss members 33–35 are retracted, the system 10 can be moved efficiently without hindrance through the mine positioned. When the desired location for operation of the system 10 is reached, the truss members 33–35 are extended from rib to rib in the mine passageway. In a retracted position the ends of the trusses are suitably spaced from the ribs so as not to interfere with the movement of the system 10 through the mine.

The collapsible feature of each of the truss members and in particularly the truss member 35 shown in FIGS. 8 and 9 is accomplished by providing a telescoping structure formed by a pair of box being-like elements 216 and 218 that include the respective end portions 36 and 38, as discussed above and illustrated in FIG. 1. The elements 216 and 218 are positioned on opposite ends of a center beam 220, and the elements 216 and 218 are movable by suitable hydraulic means, such as piston cylinder assemblies (not shown) toward one another to extend and retract the total length of the truss member 35.

For example, in FIG. 8 the truss member 35 is shown in a fully extended position, and in FIG. 9 the truss member 35 is shown in a fully retracted position. The movement of the elements 216 and 218 on the center beam 220 is controlled by a stabilizing mechanism generally designated by the numeral 222. The stabilizing mechanism 222 includes a retainer 224 for receiving a pair of bars 226 connected at their opposite end portions to brackets 228. Relative movement of the elements 216 and 218 on the center beam 220 move the bars 226 relative to the retainer 224. This arrangement maintains movement of the elements 216 and 218 on beam 220 in a transverse direction and prevents relative bending or twisting of the elements 216 and 218 on the center beam 221 as they are moved.

Further to maintain longitudinal movement of the elements 216 and 218 on the center beam 220 there is provided a guide mechanism generally designated by the numeral 230 that includes longitudinally extending slots 232 provided in spaced parallel relation on each of the elements 216 and 218, as illustrated in FIGS. 8 and 9. The slots 232 and 234 overlie pins 236. Preferably a pair of pins 236 are positioned in spaced relation in alignment with the respective slots 232 and 234. The pins 236 engage the elements 216 and 218 to guide the elements along the path provided by slots 232 and 234. Also in view of the fact that the slots have closed end portions the elements 216 and 218 are not permitted to be removed from the ends of the center beam 220.

The length of each of the truss members is adjustable so as to adjust the width of the entire system 10. By reducing the length of each beam the props 30 and 32, the ground engaging shoes 46, and the stabilizer mechanism 78 are moved toward each other. Reducing the length of the truss members 33–35 makes it easier to move the entire system through a mine passageway. Once the system 10 has reached its point of operation the truss members 33–35 are extended in length by the above arrangement to extend transversely the full width between the ribs or walls of the mine passageway. Although not shown in detail in FIGS. 11, 12, 13, and 15, the truss members of the alternative embodiment generally shown therein could be configured to provide similar adjustability as the truss member 33, 34, and 35. A further discussion of this feature will be provided in detail hereinbelow.

Further there is illustrated in FIG. 10 particularly for the leading truss member 35 a pair of bar-like lights 238 mounted on a front face 240 of the truss member 35. The lights 238 are connected to a suitable source of power and when activated cast light in a forward direction of the system 10. This assists to eliminate the mine passageway and to enhance the overall safety and working efficiency of the system 10.

The truss member 35 shown in FIG. 10 also includes a dust supression system generally designated by the numeral 240 that includes a water manifold 242 and a plurality of nozzles 244 spaced longitudinally the length of the manifold 242 and communicating with the internal passage of the manifold 242. With this arrangement the manifold is connected in a suitable manner to a source of water conveyed under pressure to the manifold 242 and therefrom to the nozzles 244. The nozzles are operable to discharge the water under pressure in a spray into the mine atmosphere. The spray acts to supress airborne dust circulating in the air due to the mine atmosphere. This is particularly advantageous for supressing the dust that is generated at and around the mine face by the mining machine.

Figure 11:
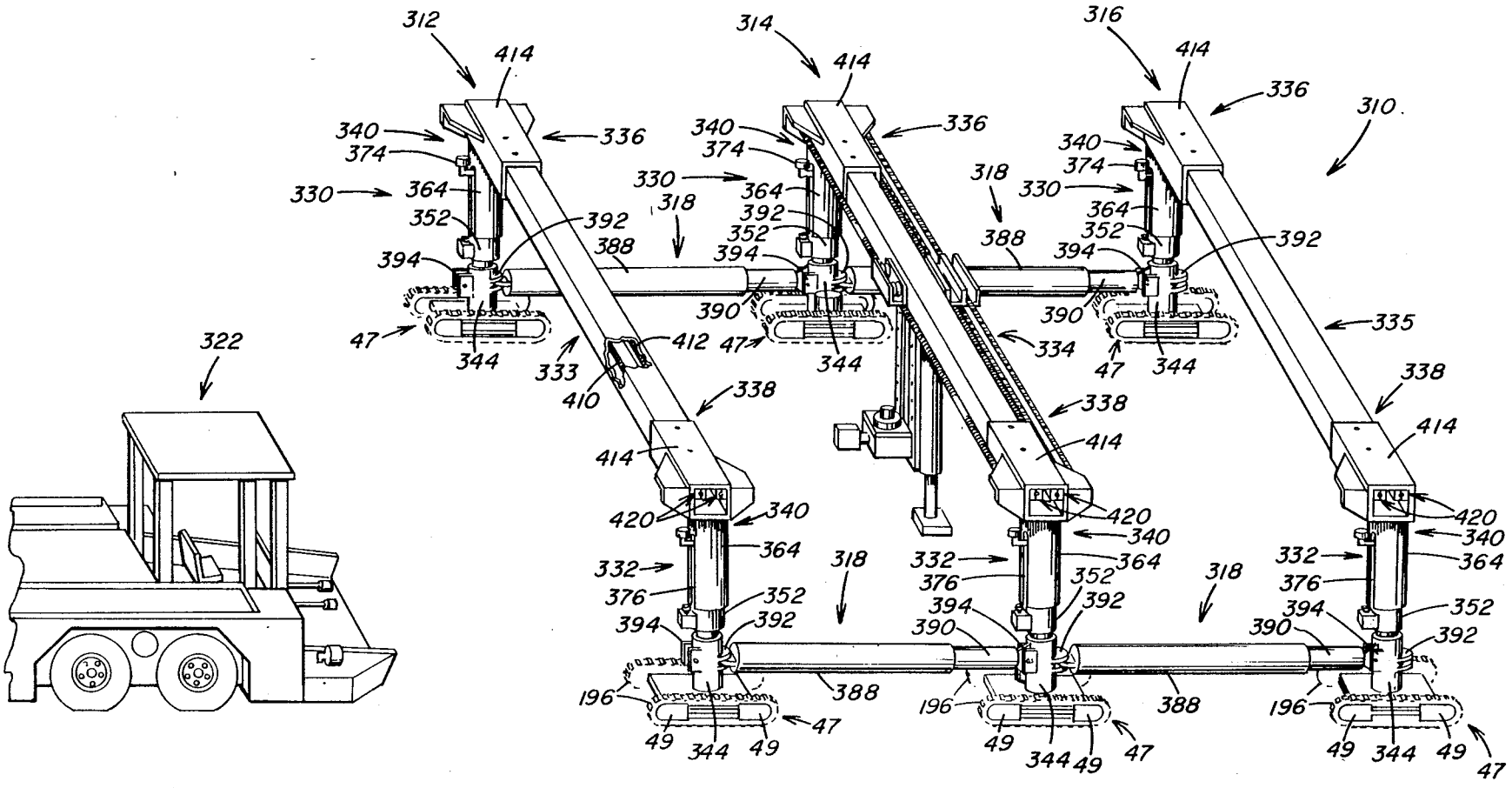
FIG. 11 is an isometric schematic illustration of a movable roof support system for use in underground mining operations similar to that of FIG. 1 but including numerous alternative features of the invention.

As seen in FIG. 11, there is illustrated an alternative mine roof support and bolter system generally designated by the numeral 310 that includes a plurality of movable roof supports 312, 314, and 316. The roof supports are interconnected by alternative horizontal tubular stabilizer assemblies 318 for limiting the horizontal movement of the roof supports along both an arcuate and linear path through the mine passageway. A hydraulic system is again employed to operate the roof supports 312, 314, and 316. Hydraulic fluid under pressure is provided by a vehicle 322, such as a vehicle 22 illustrated in FIG. 1, positioned remote from the operation of the mine roof support system 310 in the mine. FIG. 11 has been simplified by the deletion of the many hydraulic lines and control valves which would be employed to specifically operate the system 310. The disclosure relating to FIG. 1 should serve as an example of what may be needed to operate such a system but it is nevertheless felt that those skilled in the mine operating equipment art would be well aware of various types of related equipment which could be employed to operate the alternative system 310.

Although the alternative system 310 is again shown to include only three roof support units, additional units could be similarly employed if desired. Each movable roof support unit 312, 314, 316 includes alternative truss members 333, 334, and 335, respectively. Each truss member is supported by a pair of vertically extensible props 330 and 332 at its end portions to extend transversely across the mine passageway. As shown in FIG. 11, the props 330 and 332 are in a lowered position out of contact with the mine roof. The alternative truss members 333, 334, 335 can be configured to be collapsible, i.e., they can extend and retract in length transversely across the mine passageway to facilitate movement of the system 310 through the mine passageways to the desired location of operation in the mine. The manner in which the truss members can be collapsed is described in detail for truss members 33, 34, 35, but will be further discussed hereinbelow.

Each truss member has end portions 336 and 338 that are connected to top portions 340 of the props 330 and 332, as illustrated in FIGS. 15 and 16. The top portion of each prop is extensible relative to a base portion 344. The base portion 344 of each prop 330 and 332 is supported by a ground engaging means which is preferably in the form of the crawlers 47 which were discussed as an alternative to the system 10 described hereinabove.

Each of the props 330 and 332 are operable by actuation of the hydraulic system to extend and retract the top portion 340 relative to the base portion 344 to, in turn, raise and lower the respective roof truss members to move them into and out of engagement with the mine roof to support the mine roof as a mining machine or any other vehicle is operating in the mine passageway beneath the roof support system 310. The props 330 and 332 for each truss member can be operated synchronously to provide uniform raising and lowering of the respective truss member and, of course, each pair of props 330 and 332 is individually operated.

As illustrated in FIGS. 11, 15, and 16 each prop 330 and 332 is associated with a combination guide and stabilizer mechanism generally designated by the numeral 348. The mechanism 348 for the props 332 is shown in detail in FIGS. 15 and 16. It should be understood that the same arrangement is provided for each of the props 330.

Each mechanism 348 is preferably mounted on the prop ground engaging means which, as shown in FIGS. 6, 7, and 7A, includes driven crawlers 47. It should be understood that the props 330 and 332 could be employed on the system 10, but are specifically included in the alternative system 310 for the purpose of a detailed description of their various features. Each of the mechanisms 348 is connected at an upper end thereof to the end portions 336 and 338 of the respective truss members. Each of the mechanisms 348 includes a tubular member 352 mounted on the base portion 344. Extending upwardly out of the tubular member 352 is an extensible portion 354 having an upper end 356. Preferably a cap member 358 is secured, as by welding, to the extensible portion upper end 356. Aligned guide holes 360 and 362 extend transversely through the cap member 358 and into the extensible portion 354. With this arrangement, the cap member 358 moves upwardly and downwardly with the prop extensible portion 354.

The respective end portion 336 and 338 of each truss member is connected to the upper end 356 of the prop extensible portion 354 by a stabilizer sleeve 364, shown in detail in FIGS. 15 and 16, which is welded to the bottom of the truss. The stabilizer sleeve 364 extends downwardly from the respective truss member in surrounding concentric relation with the cap member 356 and extensible portion 354. The sleeve 364 includes an inside diameter that is greater than the outer diameter of the prop tubular member 352.

Thus, a lower end 366 of the sleeve 364 extends below the extensible portion 354 into overlying relation with the prop tubular member 352. The sleeve 364 also includes a transverse guide hole 368 which is aligned with the guide holes 360 and 362. A pin 370 extends into the aligned guide holes 368, 360, and 362, and includes a cotter pin 372 to limit its advancement into the holes. In this manner, the sleeve 364 is connected to the extensible portion 354 to, in turn, connect the truss member to the upper end of the props.

The stabilizer sleeve 364 moves with the prop extensible portion 354 upon extension and retraction of the prop extensible portion 354 to raise and lower the respective truss member. The props 330 and 332 are hydraulically controlled and are provided with suitable fittings, such as fitting 374 shown in FIGS. 15 and 16, to complete the hydraulic connections. In view of the fact that the sleeve 364 is movable on the outer surface of the prop tubular member 352, the sleeve 364 is provided with a vertical slot 376 aligned with the fitting 374 to permit unobstructed downward movement of the stabilizer sleeve 364.

The sleeve 364 serves to guide the movement of the extensible portion 354 by being positioned on the tubular member 352 so that bending of the extensible portion 354 is resisted. In this manner, the sleeve 364 serves to stabilize the truss member above the prop. Additionally, when the extensible portion 354 is vertically advanced to move the truss member against the mine roof, the sleeve 364 being connected to the truss member tends to transfer much of the load to the prop tubular member 352, the prop base portion 344 and ground engaging crawlers 47. In this manner, the prop extensible portion 354 is relieved of a substantial amount of the bearing load from the truss member.

As illustrated in FIG. 11, the alternative horizontal stabilizer assemblies 318 interconnect the props 330 and 332 at the respective end portions 336 and 338 of the truss members 333, 334, and 335. This arrangement permits each of the truss members to be independently advanced relative to the other truss members. Each assembly 318 includes a cylinder portion 388 and an extensible portion 390 movable into and out of the cylinder portion. The assemblies 318 connect adjacent sets of props 330 and 332. The cylinder portions 388 are connected by brackets 392 to the prop base portions 344, and the extensible portions 390 are also connected by brackets 394 to the adjacent prop base portion 344 at the opposite side thereof. Unlike the piston cylinder assemblies 18 of the mine roof support system 10 described hereinabove, the length of extension and retraction of the assemblies 318 is basically initiated and determined by movement of the motorized crawlers 47.

Preferably, as also seen in FIG. 14, the cylinder portions 388 and extensible portions 390 are tubular in construction. The cylinder portion 388 has a through bore in which the extensible portion 390 is slidably retained. Accordingly, the length that the portion 390 extends from the cylinder portion 388 determines the spacing between adjacent props 330, 332 and truss members 333, 334, and 335. However, the specific length of extension of the horizontal stabilizer assemblies 318 is limited by a preferred pin and slot mechanism generally designated by the numeral 396 in FIG. 14.

In some mines, it has been determined, for operating safety purposes, that specific limits on the distances between adjacent truss members should be maintained. The pin and slot mechanism 396 can be conveniently and simply employed to insure that these preselected limits will not be inadvertently exceeded. The mechanism 396 includes a slot 398 having closed end portions 400 and 402 in the prop extensible portion 390. Overlying the slot 398 is a series of spaced holes 404, 406, and 408 for receiving a locking pin (not shown) in the cylinder portion 388 of each assembly 318. The holes 404, 406, and 408 are aligned with and open into the slot 398. When the locking pin is positioned in one of the holes 404, 406, 408 the amount of extension of the extensible portion 390 is limited by engagement of the pin with the slot closed end portion 402. For example, extensions of 4 feet, 4.5 feet, and 5 feet can be obtained by positioning the locking pin in the holes 408, 406, and 404 respectively.

It should now be clear that the alternative system 310 includes a means for producing horizontal movement of the truss members in both a straight line and curved path through the manipulation of the individual crawlers 47. As mentioned hereinabove, whenever a particular truss member is lowered from contact with the mine roof, that truss member can be moved horizontally through the operation of the crawlers 47. Clearly, in order to obtain the desired movement of the truss members, each of the crawlers 47 should be selectively operable and independently operable with respect to each of the other crawlers 47. The preferred crawler 47 is rigidly secured to the prop base portion 344 to be generally aligned perpendicular to the truss member for obvious horizontal movement in a direction generally perpendicular to the truss member. Since the crawlers 47 can be selectively operated, they can be operated in either a forward or a reverse direction.

The tracks 196 of the crawlers 47 are intended to make gripping, frictional contact with the mine floor for selective movement of the props and truss members supported thereby. However, if one were to attempt to operate a crawler 47 beyond the limit established by the associated assembly 318, the frictional contact produced by the tracks 196 would not be capable of producing continued movement of the crawler 47. The tracks 196 would simply continue to make sliding contact with the mine floor until the operation of the crawler 47 is discontinued. Additionally, because of the type of frictional contact created by the crawlers 47 with the mine floor, each of the crawlers 47 is further capable of generally pivoting about an axis perpendicular to the mine floor. In other words, the horizontal movement of the truss members by the crawlers 47 can be in a generally curved path when the props 330, 332 are being acted on by outside forces associated with the other props, the other truss members, and the connecting assemblies 318. As a result, it has been found that through selective forward and reverse operation of the various crawlers 47, the individual truss members 333, 334, and 335 can be maipulated, when selectively lowered from the roof, to cause the entire system 310 to be moved through an arcuate path for advancement through curved passageways in the mine system. It should be understood that even though the particular crawler tracks 196 would not appear to be specifically configured for pivotal movement, they have nevertheless been found to be capable of making such sliding contact with the mine floor to allow the associated prop to pivot as desired.

As presently configured, one would not expect the crawlers 47 or the tracks 196 associated therewith to be capable of sliding sideways. However, it has been found that the tracks 196 will still have a tendency to effectively move sideways when, for example, they are being operated in one direction and the associated truss members are being simultaneously, longitudinally expanded as the system 310 is being brought to a particular location for specific use within the mine. Although not shown in detail in the Figures, each of the crawlers 47 can include some type of side deflecting means 49 to insure that the crawlers 47 will be properly deflected from the ribs or sidewalls of the mine during movement therethrough. As a result, it has been found that the alternative system 310 which utilizes the individually, selectively operable crawlers 47 with the associated horizontal stabilizer assemblies 318 is capable of being conveniently and selectively controlled to provide linear or curved movement through the mine.

Preferably, as with the truss members 33, 34, 35, the alternative truss members 332, 334, 336 are collapsible so as to permit the length to be adjusted to accommodate the various widths of the mine passageways through which the system 310 travels. When the desired location for operation of the system 310 is reached, the truss members are extended from rib to rib in the mine passageway. Although the collapsible feature of each of the truss members is not specifically shown in the Figures for the alternative system 310, it could be accomplished by providing telescoping structure including a pair of box-like elements which are positioned on opposite ends of a center beam. The elements and center beam would be relatively movable by suitable hydraulic means (not shown), such as piston cylinder assemblies, toward and away from one another to retract and extend the truss member.

As thus described, it would appear that the alternative truss members are similar to the truss members 33, 34, 35 of the system 10. However, a major intermediate portion of the alternative truss members 333, 334, 335 are fabricated of a preferred material that permits the truss members to deflect under load and spring back to an undeflected, horizontal configuration after the load has been removed. Accordingly, each truss member 333, 334, 335 includes a molded box beam structure of reinforced fiberglass, having elastic properties which permit significant, measurable deflection without any permanent deformation. The molded box beam structure could include the box-like elements and the center beam if the truss members 333, 334, and 335 are provided the adjustable feature described hereinabove. Preferably, the box beam structures are fabricated of fiberglass and reinforce with thermosetting polyester or vinyl ester resin systems. A commercially available source for the reinforced fiberglass structures suitable for use in the present invention in Morrison Molded Fiber Glass Company, Bristol, VA.

By fabricating the truss members 333, 334, and 335 primarily of reinforced fiberglass, the truss members are capable of deflecting under the weight of the mine roof without incurring permanent bending or deformation as might be encountered with a metal truss member. For example, a reinforced fiberglass truss member of the present invention having a box beam configuration of $5'' \times 7'' \times \frac{3}{4}''$ about 20 feet long can deflect up to 14 inches without failure or permanent deformation. As shown in a schematic view in FIG. 17, if the truss member 333 were under a no load or low load condition, it would normally extend horizontally against the roof (not shown). However, if the weight of the roof were such that a high loading were placed on the fiberglass box beam structure, it could deflect downwardly from the horizontal position to a distance D, as seen in FIG. 18, without any permenant deformation. After the load is released, as by lowering the truss member 333, the box beam structure would be capable of returning to the original horizontal position as shown in FIG. 17.

It can now be seen that if the maximum allowable deflection of the truss member prior to exceeding the elastic limits can be predetermined, the specific deflection of the truss member can be used as a warning against excessive loading. Consequently, noting that there exists excessive deflection of the truss member will provide operating personnel with sufficient warning to give them time to move to a point of safety or provide additional reinforcement for the mine roof. Generally, failure of truss member would be coincident with a roof fall. As a result, the degree of deflection of the truss members from a horizontal position under the weight of the mine roof can provide an indication of the stability of the mine roof above the respective truss member. If the truss member deflects and the deflection is not beyond the elastic limit of the truss member, the truss member will return or spring back to its original horizontal position when the load is removed by the props 330 and 332 being retracted to lower a truss member out of contact with the mine roof.

It has been found that the reinforced fiberglass truss members are not only stronger than conventional steel truss members but weigh approximately 80% less than steel. The elastic characterstics of fiberglass truss members has been found to overcome the problems of creep or sag often encountered with steel truss members under fatigue loading or as a result of prolonged deformation. In addition, the fiberglass truss members are corrosion resistant and, therefore, are particularly desirable for use in the corrosive environment of an underground mine. Further, since the fiberglass truss members are nonconductive, they act as insulators in the event of a fault as opposed to steel truss members which are conductive and present substantial hazards in the event of a fault.

Even though the alternative truss members 333, 334, 335 as thus described can provide safe, reliable roof support, the alternative system 310 includes additional means for safety and reliability. The additional means are provided by the inclusion of wire rope strands 410 and 412 which are positioned in and extend the length of each of the truss members. The strands 410 and 412 add additional strength to reinforce the truss member when it is being deflected. The preferred positioning of the strands 410 and 412 in the truss members causes them to operate in a manner similar to a conventional rope truss in supporting a mine roof. However, the utilization of the strands 410 and 412 as a rope truss is accomplished in the system 310 without having to specifically anchor the strands 410 and 412 to the mine roof. Since the strands 410 and 412 are connected to the truss members, they are movable with the truss members and thus avoid various problems frequently encountered in permanently installing a wire rope roof truss.

As seen in FIGS. 11, 12, 13, and 15 the strands 410 and 412 are preferably clamped at their end portions to the interior ends of the respective truss members 333, 334, and 335. As best seen in FIG. 15, each fiberglass portion of the truss member has an end portion 336 or 338 positioned in a surrounding box-like supporting member 414. The supporting member 414 is connected, as by welding, to the top of the sleeve 364 that extends downwardly over the prop extensible portion 354. The supporting member 414 is preferably fabricated of steel with the fiberglass end portions 336 and 338 being suitably connected to the supporting members 414 as by a pin extending through aligned holes 416 and 418 of the respective supporting member 414 and end portions 336 and 338.

The wire rope strands 410 and 412 are connected by a pair of clamps 420 to the interior ends of the supporting members 414 above the sleeves 364. Each clamp 420 includes a pair of components 422 and 424 having oppositely positioned clamping surfaces 426 and 428 provided with arcuate recessess for receiving the ends of each strand 410 and 412. The clamp components 422 and 424 are secured together by bolts 430. It should be understood that each clamp component 424 is rigidly secured, by desired means, to the interior wall of the supporting member 414 and that tightening the bolts 430 compresses the ends of the strands 410 and 412 securely between the clamp components 422 and 424. In this manner the ends of the strands 410 and 412 are connected relative to the respective ends 336 and 338 of the truss members 333, 334, 335.

Having explained how the ends of the wire rope strands 410 and 412 can be properly connected to the ends of the truss members 333, 334, and 335, it is appropriate to discuss the specific relationships of the strands within the truss members. Preferably, during assembly, the strands will be mounted with a slight slack as they lie within their particular truss members. In other words, as the truss members are initially deflected under the weight of a mine roof, the strands 410 and 412 will not initially be brought into contact with the interior wall of the truss members. However, with continued deflection of the truss members 333, 334, and/or 335, the strands will make contact with the interior surface thereof to provide some of the resistance needed for supporting the mine roof. As a result, the strands 410 and 412 will add some support to the mine roof but will not automatically prevent the major portion of the truss members from being deflected as an indicator of the load thereon. Admittedly, if the truss members were to deflect past the point of failure, it is not expected that the wire rope strands 410, 412 would have sufficient strength to totally support the mine roof. On the other hand, by adding additional strength to the truss members, the truss members would not normally be expected to fail because the additional strength being added by the wire rope strands 410, 412. It might be noted that the inclusion of the wire rope strands 410, 412 do not interfere with the overall purpose of the measurable deflection of the truss members since the amount of deflection will still be indictive of a load condition which might bring the truss members to the point of failure. Accordingly, the strands 410, 412 might alter the magnitude of the load being actually supported by the truss members prior to failure, but would not interfere with the subsequent deflection of the truss members which would indicate that they could be in a condition approaching failure because of the particular load being supported thereby.

Although the description of the preferred system 10 and the alternative system 310 includes various features which are specifically incorporated in the particular embodiments discussed therein, it should be clear that appropriate features could be incorporated in any one or the other of the embodiments as described. Accordingly, it should be clear that numerous alterations can be made to the embodiments of the invention while still falling within the scope of the invention as claimed.

I claim:

1. A mine roof support system comprising:

a plurality of truss members each having first and second ends, said truss members being positioned in spaced relationship one behind another;

a plurality of vertically extensible props each having an upper end portion and a lower end portion and including means for extending and retracting said upper end portion relative to said lower end portion to adjust a vertical height of said props;

one of said props being positioned under each of said ends of each said truss member;

said upper end portion of said prop being connected to a respective said end of said truss member so that said each truss member is supported by a pair of said props for movement into and out of engagement with a mine roof;

ground engaging means for supporting each said prop at said lower end portion thereof for movement on a mine floor;

connecting means beneath said ends of said truss members for connecting adjacent props in tandem arrangement to permit limited horizontal movement of said truss members and associated props relative to each other;

roof drilling means mounted on at least one of said truss members for vertical movement relative to said truss member for drilling bolt holes and installing bolts in mine roof, said roof drilling means being movable between said prop to said preselected position on said truss member for drilling bolt holes and installing roof bolts at a plurality of location in the mine roof of said truss member, and each of said truss members being horizontally expandable to facilitate transportation through a mine prior to being positioned for said movement into and out of said engagement with said mine roof.

2. The mine roof support system as set forth in claim 1, wherein said truss member includes an elongated intermediate portion secured to said first and said second ends for relative longitudinal movement therebetween to be capable of varying a horizontal distance between said first end and said second end.

3. The mine roof support system as set forth in claim 2, further including stabilizing means for stabilizing said truss member independant of said elongated intermediate portion being secured to said first and said second ends.

4. A mine roof support system comprising, a plurality of truss members each having first and second end portions, said truss members being positioned in spaced relation one behind the other, a plurality of vertically extensible props each having an upper end portion and a lower end portion and including means for extending and retracting said upper end portion relative to said lower end portion to adjust the vertical height of said props, one of said props being positioned under said end portion of each truss member, said prop upper end portion being connected to a respective truss member end portion so that each truss member is supported by a pair of said props for movement into and out of engagement with a mine roof, ground engaging means for supporting each prop for slidable movement on a mine floor, extensible means for connecting adjacent props in tandem arrangement beneath said truss member first and second end portions to permit advancement of said truss members and associated props relative to each other in a linear path, and means for raising from contact with the mine floor all of said ground engaging means of said props beneath one of said end portions of said truss members as said props at the other ends of said truss members are forwardly advanced to pivot said truss members for movement about a pivot point for movement of the mine roof support system in an arcuate path.

5. A mine roof support system as set forth in claim 4 which includes, roof drilling means mounted on at least one of said truss members for vertical movement relative to said truss member for drilling bolt holes and installing roof bolts in the mine roof, and said roof drilling means being movable between said props to a preselected position on said truss member for drilling bolt holes and installing roof bolts at a plurality of locations in the mine roof above said truss member.

6. A mine roof support system as set forth in claim 5 which includes, means mounted on said truss member for moving said roof drilling means to a selected location on said truss member for drilling a bolt hole and installing a roof bolt in the mine roof, and said means for moving said roof drilling means being supported by said truss member for movement to a desired position thereon between said props.

7. A mine roof support system as set forth in claim 4 which includes, a ventilation curtain being supported by said truss members in a preselected position adjacent a wall of a mine passageway, means for suspending said ventilation curtain from said truss members to move with said truss members, and said ventilation curtain being operable to expand and contract in length as said truss members move relative to one another.

8. A mine roof support system as set forth in claim 4 which includes, means mounted on at least one of said truss members for movement along the length of said truss member to a preselected location for drilling bolt holes and installing roof bolts in the mine roof, and means carried by the roof support system and connected to said means for drilling bolt holes for collecting the dust generated during the drilling operation.

9. A mine roof support system as set forth in claim 4 in which, said ground engaging means includes a shoe positioned for slidable movement on the mine floor, said extensible means being mounted on said shoe and including a piston cylinder assembly, said piston cylinder assembly including a piston portion retained in said shoe, and said piston portion being extendable from said shoe to raise said shoe from contact with the mine floor where said piston portion engages the mine floor and said shoe is removed from contact with the mine floor.

10. A mine roof support system as set forth in claim 9 in which, said piston portion when extended into contact with the mine floor raises said props beneath one end of said truss members out of engagement with the mine floor for pivotal movement of said props and said truss members about said extended piston portion.

11. A mine roof support system comprising, a plurality of truss members each having first and second end portions, said truss members being positioned in spaced relation one behind the other, a plurality of vertically extensible props each having an upper end portion and a lower end portion and including means for extending and retracting said upper end portions relative to said lower end portion to adjust the vertical height of said props, one of said props being positioned under each end portion of each of said truss members, each prop upper end portion being connected to a respective truss member end portion so that each truss member is supported by a pair of props for movement into and out of engagement with a mine roof, ground engaging means for supporting each prop for slidable movement on a mine floor, extensible means for connecting adjacent props in tandem arrangement beneath said truss member first and second end portions to permit advancement of said truss members and associated props relative to each other, means for stabilizing said extensible means upon the advancement of said truss members and associated props relative to each other, roof drilling means mounted on at least one of said truss members for vertical movement relative to said truss member for drilling bolt holes and installing roof bolts in the mine roof, said roof drilling means being movable between said props to preselected positions on said truss member for drilling bolt holes and installing roof bolts at a plurality of locations in the mine roof above said truss member, and said roof drilling means being movable with said truss to progressively drill bolt holes and install roof bolts at desired locations in the mine roof.

12. A mine roof support system as set forth in claim 11 which includes, means for raising from contact with the mine floor all of said ground engaging means of said props beneath one of said end portions of said truss members as said props at the other ends of said truss members are forwardly advanced to pivot said truss members for movement about a pivot point for movement of the mine roof support system in an arcuate path.

13. A mine roof support system as set forth in claim 11 which includes, remote control means for moving said roof drilling means to a selected position on said truss member for drilling bolt holes and installing roof bolts in spaced relation in a straight line across the mine roof, and said remote control means being movable with the mine roof support system to provide continuous operation of drilling bolt holes and installing roof bolts in the mine roof.

14. A mine roof support system as set forth in claim 11 which includes, means mounted on said truss member for moving said roof drilling means to a selected location on said truss member for drilling a bolt hole and installing a roof bolt in the mine roof, and said means for moving said roof drilling means being supported by said truss member for movement to a desired position thereon between said props.

15. A mine roof support system as set forth in claim 11 in which, said roof drilling means includes a vertically movable drill including means for anchoring said drill on the mine roof for vertical relative to said truss member, a frame for supporting said drill for movement along the length of said truss member, and driven means connected to said frame for translating said frame back and forth on said truss member to position said drill in a selected position for drilling bolt holes in the mine roof above said truss member.

16. A mine roof support system as set forth in claim 11 which includes, a ventilation curtain being supported by said truss members in a preselected position adjacent a wall of a mine passageway, means for suspending said ventilation curtain from said truss member to move with said truss member, and said ventilation curtain being operable to expand and contract in length as said truss members move relative to one another.

17. A method for temporarily supporting a mine roof comprising the steps of , positioning a plurality of truss members in a spaced relation extending substantially the width of a mine passageway so that the truss members are positioned one behind the other, supporting first and second end portions of the truss members by props positioned on a mine floor for vertical movement of the truss members into and out of engagement with a mine roof, connecting the props in tandem relation for movement of the truss members in the mine passageway, raising a selected truss member into engagement with the mine roof while lowering the remaining truss members out of contact with the mine roof for advancement of the lowered truss members in a selected direction in the mine passageway, advancing along a linear path the props supporting the lowered truss members to move the lowered truss members relative to the truss member engaging the mine roof, raising the set of props beneath the first end portion of the lowered truss members out of contact with the mine floor for support about a pivot point on the mine floor, advancing on the mine floor the set of props beneath the second end portion of the lowered truss members while maintaining the set of props beneath the first end portion of the lowered truss members fixed to pivot the second end portion of the lowered truss members relative to the first end portion thereof to move the truss member along an arcuate path to change the direction of advancement of the truss members.

18. A method for temporarily supporting a mine roof as set forth in claim 17 which includes, supporting roof drilling means on at least one of the truss members for movement to a selected position thereon for drilling bolt holes and installing roof bolts in the mine roof above said truss members, and moving the roof drilling means into and out of engagement with the mine floor to anchor the roof drilling means on said truss member during the drilling and bolting operations.

19. A method for temporarily supporting a mine roof as set forth in claim 17 which includes, pivoting the truss members about the fixed pivot point so that all of the truss members move together in an arcuate path to execute a turn of the truss member around a corner in the mine passageway.

20. A method for temporarily supporting a mine roof as set forth in claim 17 which includes, hanging a ventilation curtain in a selected position from the truss members, and advancing the ventilation curtain with truss members to move the ventilation curtain in a selected position in the mine passageway.

* * * * *